US009719022B2

(12) United States Patent
Moran et al.

(10) Patent No.: US 9,719,022 B2
(45) Date of Patent: Aug. 1, 2017

(54) METHODS FOR SEPARATING A FEED MATERIAL DERIVED FROM A PROCESS FOR RECOVERING BITUMEN FROM OIL SANDS

(75) Inventors: Kevin Moran, Edmonton (CA); Jacques Doiron, Devon (CA)

(73) Assignee: TITANIUM CORPORATION INC. (CA)

( * ) Notice: Subject to any disclaimer, the term of this patent is extended or adjusted under 35 U.S.C. 154(b) by 1442 days.

(21) Appl. No.: 13/166,437

(22) Filed: Jun. 22, 2011

(65) Prior Publication Data

US 2012/0000831 A1 Jan. 5, 2012

Related U.S. Application Data

(63) Continuation-in-part of application No. 12/426,538, filed on Apr. 20, 2009, now Pat. No. 8,382,976, and a continuation-in-part of application No. 12/721,991, filed on Mar. 11, 2010, now Pat. No. 8,852,429.

(30) Foreign Application Priority Data

| | | |
|---|---|---|
| Apr. 9, 2009 | (CA) | 2662346 |
| Feb. 22, 2010 | (CA) | 2693879 |
| Jun. 21, 2011 | (CA) | 2743836 |

(51) Int. Cl.
*C10G 1/04* (2006.01)
*B03D 1/02* (2006.01)

(52) U.S. Cl.
CPC ..... *C10G 1/045* (2013.01); *B03D 1/02* (2013.01); *B03D 2203/006* (2013.01); *C10G 2300/4081* (2013.01); *C10G 2300/44* (2013.01); *C10G 2300/802* (2013.01)

(58) Field of Classification Search
CPC ..... C10G 1/04
See application file for complete search history.

(56) References Cited

U.S. PATENT DOCUMENTS

| | | | | |
|---|---|---|---|---|
| 3,553,099 A | * | 1/1971 | Savage et al. | 208/390 |
| 3,594,306 A | | 7/1971 | Dobson | |
| 3,656,938 A | | 4/1972 | Penzes | |
| 3,784,464 A | | 1/1974 | Kaminsky | |
| 3,893,907 A | | 7/1975 | Canevari | |
| 3,990,885 A | | 11/1976 | Baillie et al. | |
| 4,138,467 A | | 2/1979 | Kaminsky et al. | |
| 4,150,093 A | | 4/1979 | Kaminsky et al. | |
| 4,225,422 A | | 9/1980 | Trevoy et al. | |
| 4,226,690 A | | 10/1980 | Martin | |
| 4,331,532 A | * | 5/1982 | Bose | 208/391 |
| 4,460,452 A | * | 7/1984 | Johnson et al. | 208/390 |
| 4,514,305 A | * | 4/1985 | Filby | 208/391 |
| 5,106,489 A | | 4/1992 | Schmidt et al. | |
| 5,316,664 A | | 5/1994 | Gregoli et al. | |
| 5,968,349 A | * | 10/1999 | Duyvesteyn | C10G 32/00 208/390 |
| 6,074,558 A | | 6/2000 | Duyvesteyn et al. | |
| 7,341,658 B2 | | 3/2008 | Reeves | |
| 2007/0272596 A1 | | 11/2007 | Erasmus et al. | |

FOREIGN PATENT DOCUMENTS

| | | | |
|---|---|---|---|
| CA | 861580 | | 1/1971 |
| CA | 879996 | | 8/1971 |
| CA | 927983 | | 6/1973 |
| CA | 975696 | | 10/1975 |
| CA | 975697 | | 10/1975 |
| CA | 975698 | | 10/1975 |
| CA | 975699 | | 10/1975 |
| CA | 975700 | | 10/1975 |
| CA | 1013696 | | 7/1977 |
| CA | 1027501 | | 3/1978 |
| CA | 1076504 | | 4/1980 |
| CA | 1081642 | | 7/1980 |
| CA | 1088883 | | 11/1980 |
| CA | 1094484 | | 1/1981 |
| CA | 1238597 | | 6/1988 |
| CA | 1252409 | | 4/1989 |
| CA | 2000068 | | 4/1991 |
| CA | 1326571 | | 1/1994 |
| CA | 2021185 | * | 9/1998 |
| CA | 2149737 | | 3/1999 |
| CA | 2084261 | | 2/2000 |
| CA | 2358805 | | 10/2001 |

(Continued)

OTHER PUBLICATIONS

Oxenford et al., Second International Heavy Minerals Conference, "Heavy Minerals From Alberta Oil Sands—Setting New Standards?", dated Oct. 8, 2003 (22 pages).
Alberta Energy, "Oil Sands Facts," Alberta Department of Energy, 2002, 3 pp.
Power, W.J., Paper #9, 6th Int'l. Conf. on Petroleum Phase Behaviour and Fouling, Amsterdam, Jun. 19-23, 2005, 39 pp.
Shaw, R.C. et al., "Suspensions in the Hot Water Flotation Process for Canadian Oil Sands," in Suspensions: Fundamentals & Appls in the Petroleum Industry . . . , 1996, pp. 639-675.

*Primary Examiner* — Randy Boyer
(74) *Attorney, Agent, or Firm* — Terrence N. Kuharchuk; Rodman & Rodman

(57) ABSTRACT

Separation methods for producing an extract and a raffinate from a solvent extraction feed material, wherein the feed material is derived from a process for recovering bitumen from oil sands. The methods may include producing an intra-stage recycle component from an overflow zone of a solvent extraction stage and recycling the intra-stage recycle component to the solvent extraction stage, and/or the methods may include providing an underflow component withdrawal rate for a solvent extraction stage other than a final solvent extraction stage which is greater than an underflow component withdrawal rate for the final solvent extraction stage.

34 Claims, 6 Drawing Sheets

(56) References Cited

FOREIGN PATENT DOCUMENTS

| | | |
|---|---|---|
| CA | 2426113 | 10/2003 |
| CA | 2272035 | 3/2004 |
| CA | 2787747 | 3/2004 |
| CA | 2454942 | 7/2005 |
| CA | 2353109 | 12/2005 |
| CA | 2272045 | 11/2006 |
| CA | 2548006 | 11/2007 |
| CA | 2613873 | 10/2008 |
| CA | 2638120 | 1/2010 |

* cited by examiner

| STREAM N0 | 20 | 24 | 42 | 46 | 42/104 | 70/100 | 102 |
|---|---|---|---|---|---|---|---|
| STREAM DESCRIPTION | Froth Treatment Tailings | Fine Mineral Material Fraction | First Solvent Extraction Feed Material | Froth Flotation Tailings | First Solvent Extraction Feed Material + Second Stage Overflow Product | Extract/First Stage Overflow Product | First Stage Underflow Product |
| | | | | | | | |
| Naphtha (kg/min) | 0.8500 | 0.01 | 0.01 | 0.00 | 0.49 | 0.25 | 0.16 |
| Bitumen (kg/min) | 0.0100 | 0.0900 | 0.0848 | 0.0052 | 0.1055 | 0.0792 | 0.0264 |
| Water (kg/min) | 0.1000 | 3.92 | 2.49 | 1.43 | 2.49 | 0.01 | 2.57 |
| Solid Mineral Material (kg/min) | 4.0400 | 0.49 | 0.35 | 0.14 | 0.35 | 0.00 | 0.35 |
| | | | | | | | |
| Total Mass (kg/min) | 5.00 | 4.5 | 2.93 | 1.58 | 3.44 | 0.34 | 3.10 |
| | | | | | | | |
| Diluent to Bitumen Ratio (wt./wt.) | | | | | 4.64 | | |
| Diluent to Feed Ratio (wt./wt.) | | | | | 0.142 | | |
| | | | | | | | |
| Naphtha (%wt.) | 17.00 | 0.2 | 0.22 | 0.17 | 14.33 | 74.41 | 5.0 |
| Bitumen (%wt.) | 0.20 | 2 | 2.9 | 0.3286 | 3.0674 | 23.2853 | 0.8500 |
| Water (%wt.) | 2.00 | 25 | 85 | 90.71 | 72.42 | 1.50 | 80.20 |
| Solid Mineral Material (%wt.) | 80.80 | 72.8 | 11.88 | 8.79 | 10.19 | 0.80 | 13.95 |
| | | | | | | | |
| Total (%wt.) | 100 | 100 | 100 | 100 | 100 | 100 | 100 |
| | | | | | | | |
| Bitumen Recovery (%) | | | 94.2 | | | 93.4 | |

Figure 2

| STREAM N0. | 108 | 102/108 | 104 | 72/106 |
|---|---|---|---|---|
| STREAM DESCRIPTION | Hydrocarbon Diluent | First Stage Underflow Product + Hydrocarbon Diluent | Second Stage Overflow Product | Raffinate/Second Stage Underflow Product |
| | | | | |
| Naphtha (kg/min) | 0.32 | 0.46 | 0.49 | 0.06 |
| Bitumen (kg/min) | | 0.0264 | 0.0207 | 0.0145 |
| Water (kg/min) | | 2.57 | 0.01 | 2.49 |
| Solid Mineral Material (kg/min) | | 0.35 | 0.00 | 0.34 |
| | | | | |
| Total Mass (kg/min) | 0.32 | 3.42 | 0.52 | 2.90 |
| | | | | |
| Diluent to Bitumen Ratio (wt./wt.) | | 18.18 | | |
| Diluent to Feed Ratio (wt./wt.) | | 0.140 | | |
| | | | | |
| Naphtha (%wt.) | 100 | 14.0 | 94.48 | 1.9 |
| Bitumen (%wt.) | | 0.77 | 4.02 | 0.50 |
| Water (%wt.) | | 75.1 | 1.0 | 85.71 |
| Solid Mineral Material (%wt.) | | 10.2 | 0.50 | 11.89 |
| | | | | |
| Total (%wt.) | 100 | 100 | 100 | 100 |
| | | | | |
| Bitumen Recovery (%) | | | | |

Figure 2 (continued)

| STREAM N0. | 20 | 22 | 154 | 156 | 158 | 160 |
|---|---|---|---|---|---|---|
| STREAM DESCRIPTION | Froth Treatment Tailings | Coarse Mineral Material Fraction | Rougher Stage Float Product | Rougher Stage Sink Product | Scavenger Stage Float Product | Scavenger Stage Sink Product |
| | | | | | | |
| Naphtha (kg/min) | 0.0100 | 0.0010 | 0.0007 | 0.0003 | 0.00 | 0.0001 |
| Bitumen (kg/min) | 0.1000 | 0.0100 | 0.0093 | 0.0007 | 0.00 | 0.0006 |
| Water (kg/min) | 4.0400 | 0.1250 | 0.0825 | 0.0425 | 0.01 | 0.0308 |
| Solid Mineral Material (kg/min) | 0.8500 | 0.3840 | 0.1575 | 0.2065 | 0.01 | 0.1935 |
| | | | | | | |
| Total Mass (kg/min) | 5.00 | 0.50 | 0.2500 | 0.2500 | 0.03 | 0.2250 |
| | | | | | | |
| Diluent to Bitumen Ratio (wt./wt.) | | | | | | |
| Diluent to Feed Ratio (wt./wt.) | | | | | | |
| | | | | | | |
| Naphtha (%wt.) | 0.20 | 0.20 | 0.28 | 0.12 | 0.84 | 0.04 |
| Bitumen (%wt.) | 2.00 | 2.00 | 3.72 | 0.28 | 0.50 | 0.26 |
| Water (%wt.) | 80.80 | 25.00 | 33.00 | 17.00 | 46.66 | 13.70 |
| Solid Mineral Material (%wt.) | 17.00 | 72.80 | 63.00 | 82.60 | 52.00 | 86.00 |
| | | | | | | |
| Total (%wt.) | 100 | 100 | 100 | 100 | 100 | 100 |
| | | | | | | |
| Bitumen Recovery (%) | | | | | | |

Figure 3

| STREAM N0. | 142 | 197 | 142/197/216 | 196 | 194 | 194/236 | 216 |
|---|---|---|---|---|---|---|---|
| STREAM DESCRIPTION | First Solvent Extraction Feed Material | Make-Up Water | First Solvent Extraction Feed Material + Second Stage Overflow Product + Make-Up Water | First Stage Overflow Product | First Stage Underflow Product | First Stage Underflow Product + Third Stage Overflow Product | Second Stage Overflow Product |
| | | | | | | | |
| Naphtha (kg/min) | 0.0009 | 0.0001 | 0.14 | 0.0350 | 0.0264 | 0.08 | 0.1439 |
| Bitumen (kg/min) | 0.0094 | 0.0001 | 0.01 | 0.0088 | 0.0033 | 0.0044 | 0.0026 |
| Water (kg/min) | 0.0942 | 0.0597 | 0.16 | 0.0009 | 0.2386 | 0.24 | 0.0023 |
| Solid Mineral Material (kg/min) | 0.1705 | 0.0001 | 0.17 | 0.0002 | 0.1717 | 0.17 | 0.0013 |
| | | | | | | | |
| Total Mass (kg/min) | 0.26 | 0.060 | 0.49 | 0.045 | 0.44 | 0.50 | 0.15 |
| | | | | | | | |
| Diluent to Bitumen Ratio (wt./wt.) | | | 14 | | | 18 | |
| Diluent to Feed Ratio (wt./wt.) | | | 0.29 | | | 0.16 | |
| | | | | | | | |
| Naphtha (%wt.) | 0.33 | 0.10 | 29.86 | 77.84 | 6.00 | 16.86 | 95.92 |
| Bitumen (%wt.) | 3.43 | 0.20 | 2.50 | 19.66 | 0.75 | 0.90 | 1.73 |
| Water (%wt.) | 34.24 | 99.50 | 32.19 | 2.00 | 54.23 | 47.85 | 1.50 |
| Solid Mineral Material (%wt.) | 62.00 | 0.20 | 35.44 | 0.50 | 39.02 | 34.42 | 0.85 |
| | | | | | | | |
| Total (%wt.) | 100 | 100 | 100 | 100 | 100 | 100 | 100 |
| | | | | | | | |
| Bitumen Recovery (%) | 94 | | | 88 | | | |

Figure 3 (continued)

| STREAM N0. | 214 | 244 | 214/244 | 236 | 234 |
|---|---|---|---|---|---|
| STREAM DESCRIPTION | Second Stage Underflow Product | Hydrocarbon Diluent | Second Stage Underflow Product + Hydrocarbon Diluent | Third Stage Overflow Product | Third Stage Underflow Product |
| | | | | | |
| Naphtha (kg/min) | 0.02 | 0.06 | 0.080 | 0.0579 | 0.0245 |
| Bitumen (kg/min) | 0.002 | 0.0000 | 0.002 | 0.0011 | 0.0007 |
| Water (kg/min) | 0.15 | 0.0000 | 0.15 | 0.0006 | 0.1523 |
| Solid Mineral Material (kg/min) | 0.17 | 0.0000 | 0.17 | 0.0005 | 0.1725 |
| | | | | | |
| Total Mass (kg/min) | 0.35 | 0.06 | 0.41 | 0.06 | 0.35 |
| | | | | | |
| Diluent to Bitumen Ratio (wt./wt.) | | | 40 | | |
| Diluent to Feed Ratio (wt./wt.) | | | 0.20 | | |
| | | | | | |
| Naphtha (%wt.) | 7.00 | 100.00 | 19.9 | 96.50 | 7.00 |
| Bitumen (%wt.) | 0.50 | 0.00 | 0.50 | 1.75 | 0.20 |
| Water (%wt.) | 43.69 | 0.00 | 37.3 | 1.00 | 43.52 |
| Solid Mineral Material (%wt.) | 48.81 | 0.00 | 42.3 | 0.75 | 49.28 |
| | | | | | |
| Total (%wt.) | 100 | 100 | 100 | 100 | 100 |
| | | | | | |
| Bitumen Recovery (%) | | | | | |

Figure 3 (continued)

METHODS FOR SEPARATING A FEED MATERIAL DERIVED FROM A PROCESS FOR RECOVERING BITUMEN FROM OIL SANDS

PRIORITY

This application is a continuation-in-part of U.S. patent application Ser. No. 12/426,538 filed Apr. 20, 2009 and now U.S. Pat. No. 8,382,976 and Ser. No. 12/721,991 filed Mar. 11, 2010 and now U.S. Pat. No. 8,852,429.

TECHNICAL FIELD

Separation methods for separating a feed material comprising solid mineral material, water and bitumen, wherein the feed material is derived from a process for recovering bitumen from oil sands.

BACKGROUND OF THE INVENTION

Oil sands is essentially comprised of a matrix of bitumen, solid mineral material and water.

The bitumen component of oil sands includes hydrocarbons which are typically quite viscous at normal in situ temperatures and which act as a binder for the other components of the oil sands. For example, bitumen has been defined by the United Nations Institute for Training and Research as a hydrocarbon with a viscosity greater than $10^4$ mPa s (at deposit temperature) and a density greater than 1000 kg/m$^3$ at 15.6 degrees Celsius.

The solid mineral material component of oil sands typically consists of sand, rock, silt and clay. Solid mineral material may be present in oil sands as coarse mineral material or fine mineral material. The accepted division between coarse mineral material and fine mineral material is typically a particle size of about 44 microns. Solid mineral material having a particle size greater than about 44 microns is typically considered to be coarse mineral material, while solid mineral material having a particle size less than about 44 microns is typically considered to be fine mineral material. Sand and rock are generally present in oil sands as coarse mineral material, while silt and clay are generally present in oil sands as fine mineral material.

A typical deposit of oil sands may contain (by weight) about 10 percent bitumen, up to about 6 percent water, with the remainder being comprised of solid mineral material, which may include a relatively small amount of impurities such as humic matter and heavy minerals.

Water based technologies are typically used to extract bitumen from oil sands ore originating from the Athabasca area in northeastern Alberta, Canada. A variety of water based technologies exist, including the Clark "hot water" process and a variety of other processes which may use hot water, warm water or cold water in association with a variety of different separation apparatus.

In a typical water based oil sands extraction process, the oil sands ore is first mixed with water to form an aqueous slurry. The slurry is then processed to release bitumen from within the oil sands matrix and prepare the bitumen for separation from the slurry, thereby providing a conditioned slurry. The conditioned slurry is then processed in one or more separation apparatus which promote the formation of a primary bitumen froth while rejecting coarse mineral material and much of the fine mineral material and water. The separation apparatus may also produce a middlings stream from which a secondary bitumen froth may be scavenged. This secondary bitumen froth may be added to the primary bitumen froth or may be kept separate from the primary bitumen froth.

A typical bitumen froth (comprising a primary bitumen froth and/or a secondary bitumen froth) may contain (by weight) about 60 percent bitumen, about 30 percent water and about 10 percent solid mineral material, wherein a large proportion of the solid mineral material is fine mineral material. The bitumen which is present in a typical bitumen froth is typically comprised of both non-asphaltenic material and asphaltenes.

This bitumen froth is typically subjected to a froth treatment process in order to reduce its solid mineral material and water concentration by separating the bitumen froth into a bitumen product and froth treatment tailings.

In a typical froth treatment process, the bitumen froth is diluted with a froth treatment diluent to provide a density gradient between the hydrocarbon phase and the water phase and to lower the viscosity of the hydrocarbon phase. The diluted bitumen froth is then subjected to separation by solvent extraction in one or more solvent extraction apparatus in order to produce the bitumen product and the froth treatment tailings. Exemplary solvent extraction apparatus include gravity settling vessels, inclined plate separators and centrifuges.

Some commercial froth treatment processes use naphthenic type diluents (defined as froth treatment diluents which consist essentially of or contain a significant amount of one or more aromatic compounds). Examples of naphthenic type diluents include toluene (a light aromatic compound) and naphtha, which may be comprised of both aromatic and non-aromatic compounds.

Other commercial froth treatment processes use paraffinic type diluents (defined as froth treatment diluents which consist essentially of or contain significant amounts of one or more relatively short-chained aliphatic compounds). Examples of paraffinic type diluents are C4 to C8 aliphatic compounds and natural gas condensate, which typically contains short-chained aliphatic compounds and may also contain small amounts of aromatic compounds.

Froth treatment processes which use naphthenic type diluents (i.e., naphthenic froth treatment processes) typically result in a relatively high bitumen recovery (perhaps about 98 percent), but also typically result in a bitumen product which has a relatively high solid mineral material and water concentration.

Froth treatment processes which use paraffinic type diluents (i.e., paraffinic froth treatment processes) typically result in a relatively lower bitumen recovery (in comparison with naphthenic froth treatment processes), and in a bitumen product which has a relatively lower solid mineral material and water concentration (in comparison with naphthenic froth treatment processes). Both the relatively lower bitumen recovery and the relatively lower solid mineral material and water concentration may be attributable to the phenomenon of asphaltene precipitation, which occurs in paraffinic froth treatment processes when the concentration of the paraffinic type diluent exceeds a critical level. This asphaltene precipitation results in bitumen being lost to the froth treatment tailings, but also provides a cleaning effect in which the precipitating asphaltenes trap solid mineral material and water as they precipitate, thereby separating the solid mineral material and the water from the bitumen froth.

Froth treatment tailings therefore typically contain solid mineral material, water, froth treatment diluent, and small amounts of residual bitumen (perhaps about 2-12 percent of the bitumen which was contained in the original bitumen froth, depending upon whether the froth treatment process uses a naphthenic type diluent or a paraffinic type diluent).

Much of the residual froth treatment diluent remaining in froth treatment tailings is typically recovered from the froth treatment tailings in a tailings solvent recovery unit (TSRU). The froth treatment tailings (including the tailings bitumen) are then typically disposed of in a tailings pond.

A significant amount of bitumen from the original oil sands ore is therefore typically lost to the froth treatment tailings as residual bitumen. There are both environmental incentives and economic incentives for recovering all or a portion of this residual bitumen.

In addition, the solid mineral material which is included in the froth treatment tailings comprises an amount of heavy minerals. Heavy minerals are typically considered to be solid mineral material which has a specific gravity greater than that of quartz (i.e., a specific gravity greater than about 2.65). The heavy minerals in the solid mineral material which is contained in typical froth treatment tailings may include titanium bearing minerals such as rutile ($TiO_2$), anatase ($TiO_2$), ilmenite ($FeTiO_3$) and leucoxene (typically an alteration product of ilmenite) and zirconium bearing minerals such as zircon ($ZrSiO_4$). Titanium and zirconium bearing minerals are typically used as feedstocks for manufacturing engineered materials due to their inherent properties.

Although oil sands ore may contain a relatively low concentration of heavy minerals, it is known that these heavy minerals tend to concentrate in the bitumen froth which is extracted from the oil sands ore, and therefore become concentrated in the froth treatment tailings which result from froth treatment processes, primarily as coarse mineral material. As a result, froth treatment tailings may typically contain a sufficient concentration of heavy minerals to provide an economic incentive to recover these heavy minerals from the froth treatment tailings.

Froth treatment tailings may be further processed to recover bitumen and/or heavy minerals therefrom. Froth treatment tailings may be further processed as "whole tailings", or froth treatment tailings may be separated and fractions of the separated froth treatment tailings may be further processed. Examples in the art of methods for further processing froth treatment tailings to recover bitumen and/or heavy minerals therefrom may be found in Canadian Patent No. 2,426,113 (Reeves et al), Canadian Patent Application No. 2,548,006 (Erasmus et al), and Canadian Patent Application No. 2,662,346 (Moran et al).

There remains a heed in the art for methods for separating feed materials comprising solid mineral material, water and bitumen, wherein the feed materials are derived from a process for recovering bitumen from oil sands, and wherein representative feed materials may include (but are not limited to) a bitumen froth, whole froth treatment tailings, and/or fractions of whole froth treatment tailings.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

In this document, "gravity settling" means an operation in which components of a mixture are separated using gravity, and is therefore distinguished from other separation operations such as molecular sieve processes, absorption processes, adsorption processes, magnetic processes, electrical processes, enhanced gravity settling processes, etc.

In this document, "gravity settler" includes a gravity settling vessel, an inclined plate separator, a rotary disc contactor, a thickener, and any other suitable apparatus which facilitates gravity settling, with or without the use of process aids such as flocculants and demulsifiers. In this document, gravity settler also includes a mixing apparatus which may be used in association with the gravity settling operation.

In this document, "gravity settling vessel" means a tank or other vessel into which a mixture may be introduced in order to facilitate separation of the mixture using gravity, but is distinguishable from an inclined plate separator. A gravity settling vessel may have any shape, size and/or configuration which is suitable for achieving gravity separation. A gravity settling vessel may or may not include internal structures such as weirs, sumps, launders, baffles, distributors, etc. and may or may not include internal mechanical devices such as rakes, conveyors, augers, etc.

In this document, "inclined plate separator" means an apparatus which is comprised of a plurality of stacked inclined plates onto which a mixture to be separated may be introduced so that the mixture passes along the plates in order to achieve separation of components of the mixture, and is distinguishable from a gravity settling vessel.

In this document, "enhanced gravity separation" means an operation in which components of a mixture are separated using centrifugal acceleration or centripetal acceleration resulting from rotational movement of the mixture, and is therefore distinguished from gravity separation processes.

In this document, "enhanced gravity separator" or "enhanced gravity separation apparatus" includes a centrifuge, a hydrocyclone and any other suitable apparatus which facilitates enhanced gravity separation.

In this document, "solvent extraction" means an operation in which components of a mixture are separated by adding to the mixture a suitable liquid solvent which dissolves and/or dilutes one or more components of the mixture, thereby facilitating separation of components of the mixture.

In this document, "solvent extraction apparatus" includes gravity settlers (including without limitation, gravity settling vessels, inclined plate separators, and rotary disc contactors) and enhanced gravity separators (including without limitation, centrifuges and hydrocyclones).

In this document, "froth treatment diluent" means any substance containing one or more hydrocarbon compounds and/or substituted hydrocarbon compounds which is suitable for use in diluting and/or dissolving bitumen froth in a froth treatment process.

In this document, "hydrocarbon diluent" means any substance containing one or more hydrocarbon compounds and/or substituted hydrocarbon compounds which is suitable for use for diluting and/or dissolving bitumen in the practice of the invention.

In this document, "diluent" may include a froth treatment diluent and/or a hydrocarbon diluent.

In this document, "naphthenic type diluent" means a froth treatment diluent or a hydrocarbon diluent which includes a sufficient amount of one or more aromatic compounds so that the diluent essentially exhibits the properties of a naphthenic type diluent as recognized in the art, as distinguished from a paraffinic type diluent. In this document, a naphthenic type diluent may therefore be comprised of a mixture of aromatic and non-aromatic compounds, including but not limited to such substances as naphtha and toluene.

In this document, "naphthenic froth treatment process" means a froth treatment process which uses a sufficient amount of one or more naphthenic type diluents so that the froth treatment process is recognized in the art as a naphthenic froth treatment process as distinguished from a paraffinic froth treatment process.

In this document, "paraffinic type diluent" means a froth treatment diluent or a hydrocarbon diluent which includes a sufficient amount of one or more relatively short-chain aliphatic compounds (such as, for example, C5 to C8 aliphatic compounds) so that the diluent essentially exhibits the properties of a paraffinic type diluent as recognized in the art, as distinguished from a naphthenic type diluent. In this document, a paraffinic type diluent may therefore be comprised of a mixture of aliphatic and non-aliphatic compounds, including but not limited to such substances as natural gas condensate.

In this document, "paraffinic froth treatment process" means a froth treatment process which uses a sufficient amount of one or more paraffinic type diluents so that the froth treatment process is recognized in the art as a paraffinic froth treatment process as distinguished from a naphthenic froth treatment process.

In this document, "froth flotation" means an operation in which components of a mixture are separated by passing a gas through the mixture so that the gas causes one or more components of the mixture to float to the top of the mixture and form a froth. In this document, froth flotation may be performed using flotation cells or tanks, flotation columns or any other suitable froth flotation apparatus, which may or may not include agitators or mixers, and froth flotation may include the use of flotation aids, including without limitation, surfactants and frothing agents.

In this document, "heavy minerals" includes solid mineral material which has a specific gravity greater than that of quartz (i.e., a specific gravity greater than about 2.65), including but not limited to titanium bearing minerals such as rutile ($TiO_2$), anatase ($TiO_2$), ilmenite ($FeTiO_3$) and leucoxene (typically an alteration product of ilmenite) and zirconium bearing minerals such as zircon ($ZrSiO_4$).

The present invention is directed at methods for separating a feed material comprising solid mineral material, water and bitumen, wherein the feed material is derived from a process for recovering bitumen from oil sands. The feed material may consist of, may consist essentially of, or may be comprised of a bitumen froth, whole froth treatment tailings, a fraction of whole froth treatment tailings, and/or any other suitable material derived from oil sands.

The methods of the invention are solvent extraction separation methods which are performed in one or more solvent extraction stages. As a result, the feed material may be further comprised of a hydrocarbon diluent, and/or the methods may be comprised of introducing a hydrocarbon diluent into one or more of the solvent extraction stages.

In all aspects of the invention, the methods of the invention may be comprised of any number of solvent extraction stages. In some embodiments of all aspects, the methods may be comprised of more than three solvent extraction stages. In some embodiments of all aspects, the methods may be comprised of a first solvent extraction stage and a final solvent extraction stage. In some embodiments of all aspects, the methods may be comprised of one or more intermediate solvent extraction stages.

In some embodiments of all aspects of the invention, the methods of the invention may be performed in a countercurrent manner. In some embodiments of all aspects, an extract may be produced as an overflow product in a first solvent extraction stage and a raffinate may be produced as an underflow product in a final solvent extraction stage.

In all aspects of the invention, the solvent extraction feed material may be any suitable material derived from oil sands. In some embodiments of all aspects, the solvent extraction feed material may consist of, may consist essentially of, or may be comprised of a bitumen froth. In some embodiments of all aspects, the solvent extraction feed material may consist of, may consist essentially of, or may be comprised of whole froth treatment tailings. In some embodiments of all aspects, the solvent extraction feed material may consist of, may consist essentially of, or may be comprised of a coarse mineral material fraction of whole froth treatment tailings. In some embodiments of all aspects, the solvent extraction feed material may consist of, may consist essentially of, or may be comprised of a fine mineral material fraction of whole froth treatment tailings.

In all aspects of the invention, the solvent extraction stages may be performed using any suitable solvent extraction apparatus. The solvent extraction apparatus may be similar in each solvent extraction stage or the solvent extraction apparatus may be different in some or all of the solvent extraction stages. In some embodiments of all aspects, the solvent extraction apparatus may be comprised of a mixing apparatus for mixing and/or conditioning the solvent extraction feed material.

In some embodiments of all aspects of the invention, the methods may be further comprised of introducing an amount of a hydrocarbon diluent into one or more of the solvent extraction stages. In some embodiments of all aspects, the hydrocarbon diluent may be introduced into a final solvent extraction stage.

In some embodiments of all aspects of the invention, the hydrocarbon diluent may consist of, may consist essentially of, or may be comprised of a paraffinic type diluent. In some embodiments of all aspects, the hydrocarbon diluent may consist of, may consist essentially of, or may be comprised of a naphthenic type diluent.

In a first exemplary aspect, the invention is a separation method, the method comprising:

(a) introducing a first solvent extraction feed material into a first solvent extraction stage, wherein the first solvent extraction feed material is comprised of solid mineral material, water and bitumen, and wherein the first solvent extraction feed material is derived from a process for recovering bitumen from oil sands;
(b) allowing the first solvent extraction feed material to separate in the first solvent extraction stage into an underflow zone and an overflow zone;
(c) withdrawing a first stage underflow product from the underflow zone of the first solvent extraction stage;
(d) withdrawing a first stage overflow product from the overflow zone of the first solvent extraction stage;
(e) withdrawing a first intra-stage recycle component from the overflow zone of the first solvent extraction stage; and
(f) combining the first intra-stage recycle component with the first solvent extraction feed material.

In some embodiments, the first solvent extraction feed material may be comprised of an upstream underflow product of an upstream solvent extraction stage.

In some embodiments, the first exemplary aspect may further comprise:

(a) introducing the first stage underflow product into a second solvent extraction stage as a second solvent extraction feed material;

(b) allowing the second solvent extraction feed material to separate in the second solvent extraction stage into an underflow zone and an overflow zone;

(c) withdrawing a second stage underflow product from the underflow zone of the second solvent extraction stage; and (d) withdrawing a second stage overflow product from the overflow zone of the second solvent extraction stage.

In some embodiments, the first exemplary aspect may further comprise:

(a) withdrawing a second intra-stage recycle component from the overflow zone of the second solvent extraction stage; and (b) combining the second intra-stage recycle component with the second solvent extraction feed material.

In some embodiments, the first exemplary aspect may be further comprised of introducing the second stage overflow product into the first solvent extraction stage.

In some embodiments, the first exemplary aspect may further comprise:

(a) introducing the second stage underflow product into a third solvent extraction stage as a third solvent extraction feed material;

(b) allowing the third solvent extraction feed material to separate in the third solvent extraction stage into an underflow zone and an overflow zone;

(c) withdrawing a third stage underflow product from the underflow zone of the third solvent extraction stage; and (d) withdrawing a third stage overflow product from the overflow zone of the third solvent extraction stage.

In some embodiments, the first exemplary aspect may further comprise:

(a) withdrawing a third intra-stage recycle component from the overflow zone of the third solvent extraction stage; and (b) combining the third intra-stage recycle component with the third solvent extraction feed material.

In some embodiments, the first exemplary aspect may be further comprised of introducing the third stage overflow product into the second solvent extraction stage.

In a second exemplary aspect, the invention is a separation method for producing an extract and a raffinate from a solvent extraction feed material comprising solid mineral material, water and bitumen, wherein the solvent extraction feed material is derived from a process for recovering bitumen from oil sands, wherein the separation method is comprised of a plurality of solvent extraction stages, wherein each of the solvent extraction stages produces from a stage solvent extraction feed material an overflow product from an overflow zone and an underflow product from an underflow zone, and wherein in at least one of the solvent extraction stages a stage intra-stage recycle component is produced from the overflow zone and is recycled to the solvent extraction stage.

In some embodiments of the first exemplary aspect and the second exemplary aspect, an intra-stage recycle component may be produced in each of the solvent extraction stages and may be recycled back to the solvent extraction stage.

A ratio by weight of the intra-stage recycle component to the solvent extraction feed material provides an intra-stage recycle ratio. The intra-stage recycle ratio may be similar in each solvent extraction stage or may be different in some or all of the solvent extraction stages. In some embodiments, the intra-stage recycle ratio may be between about 0.1 and 1.5. In some embodiments, the intra-stage recycle ratio may be between about 0.5 and 1.

In a third exemplary aspect, the invention is a separation method, the method comprising:

(a) introducing a first solvent extraction feed material into a first solvent extraction stage, wherein the first solvent extraction feed material is comprised of solid mineral material, water and bitumen, and wherein the first solvent extraction feed material is derived from a process for recovering bitumen from oil sands;

(b) allowing the first solvent extraction feed material to separate in the first solvent extraction stage into an underflow zone and an overflow zone;

(c) withdrawing a first stage underflow product from the underflow zone of the first solvent extraction stage at a first stage underflow product withdrawal rate;

(d) withdrawing a first stage overflow product from the overflow zone of the first solvent extraction stage at a first stage overflow product withdrawal rate;

(e) introducing the first stage underflow product into a second solvent extraction stage as a second solvent extraction feed material;

(f) allowing the second solvent extraction feed material to separate in the second solvent extraction stage into an underflow zone and an overflow zone;

(g) withdrawing a second stage underflow product from the underflow zone of the second solvent extraction stage at a second stage underflow product withdrawal rate, wherein the first stage underflow product withdrawal rate is greater than the second stage underflow product withdrawal rate;

(h) withdrawing a second stage overflow product from the overflow zone of the second solvent extraction stage at a second stage overflow product withdrawal rate; and (i) introducing the second stage overflow product into the first solvent extraction stage.

In a fourth exemplary aspect, the invention is a separation method, the method comprising:

(a) introducing a first solvent extraction feed material into a first solvent extraction stage, wherein the first solvent extraction feed material is comprised of solid mineral material, water and bitumen, and wherein the first solvent extraction feed material is derived from a process for recovering bitumen from oil sands;

(b) allowing the first solvent extraction feed material to separate in the first solvent extraction stage into an underflow zone and an overflow zone;

(c) withdrawing a first stage underflow product from the underflow zone of the first solvent extraction stage at a first stage underflow product withdrawal rate;

(d) withdrawing a first stage overflow product from the overflow zone of the first solvent extraction stage at a first stage overflow product withdrawal rate;

(e) introducing the first stage underflow product into a second solvent extraction stage as a second solvent extraction feed material;

(f) allowing the second solvent extraction feed material to separate in the second solvent extraction stage into an underflow zone and an overflow zone;

(g) withdrawing a second stage underflow product from the underflow zone of the second solvent extraction stage at a second stage underflow product withdrawal rate;

(h) withdrawing a second stage overflow product from the overflow zone of the second solvent extraction stage at a second stage overflow product withdrawal rate;

(i) introducing the second stage overflow product into the first solvent extraction stage;

(j) introducing the second stage underflow product into a third solvent extraction stage as a third solvent extraction feed material;

(k) allowing the third solvent extraction feed material to separate in the third solvent extraction stage into an underflow zone and an overflow zone;

(l) withdrawing a third stage underflow product from the underflow zone of the third solvent extraction stage at a third stage underflow product withdrawal rate;

(m) withdrawing a third stage overflow product from the overflow zone of the third solvent extraction stage at a third stage overflow product withdrawal rate; and (n) introducing the third stage overflow product into the second solvent extraction stage;

wherein at least one of the first stage underflow product withdrawal rate and the second stage underflow product withdrawal rate is greater than the third stage underflow product withdrawal rate.

In a fifth exemplary aspect, the invention is a separation method for producing an extract and a raffinate from a solvent extraction feed material comprising solid mineral material, water and bitumen, wherein the solvent extraction feed material is derived from a process for recovering bitumen from oil sands, wherein the separation method is comprised of a plurality of solvent extraction stages, wherein each of the solvent extraction stages produces an overflow product and an underflow product, wherein the extract is produced as the overflow product in a first solvent extraction stage, wherein the raffinate is produced as the underflow product in a final solvent extraction stage, and wherein an underflow product withdrawal rate of the underflow product produced in at least one of the solvent extraction stages other than the final solvent extraction stage is greater than the underflow product withdrawal rate of the raffinate.

In the third exemplary aspect, the fourth exemplary aspect and the fifth exemplary aspect, an underflow product withdrawal rate of the underflow product produced in at least one of the solvent extraction stages other than a final solvent extraction stage is greater than the underflow product withdrawal rate of the underflow product withdrawal rate produced in the final solvent extraction stage. In the third exemplary aspect, the fourth exemplary aspect and the fifth exemplary aspect, a differential is therefore provided between the underflow product withdrawal rate in at least of the solvent extraction stages and the underflow product withdrawal rate in the final solvent extraction stage.

In some embodiments of the third exemplary aspect, the fourth exemplary aspect and the fifth exemplary aspect, the differential between the underflow product withdrawal rate in at least one of the solvent extraction stages and the underflow product withdrawal rate in the final solvent extraction stage may be no greater than about the first stage overflow product withdrawal rate. In some embodiments of the third exemplary aspect, the fourth exemplary aspect and the fifth exemplary aspect, the differential between the underflow product withdrawal rate in at least one of the solvent extraction stages and the underflow product withdrawal rate in the final solvent extraction stage may be no greater than about an introduction rate of a hydrocarbon diluent into the solvent extraction stages.

In some embodiments of the third exemplary aspect, the differential between the first stage underflow product withdrawal rate and the second stage underflow product withdrawal rate may be no greater than about the first stage overflow product withdrawal rate. In some embodiments of the third exemplary aspect, the differential between the first stage underflow product withdrawal rate and the second stage underflow product withdrawal rate may be no greater than about an introduction rate of a hydrocarbon diluent into the solvent extraction stages.

In some embodiments of the fourth exemplary aspect, the first stage underflow product withdrawal rate may be greater than the third stage underflow product withdrawal rate. In some embodiments of the fourth exemplary aspect, the second stage underflow product withdrawal rate may be greater than the third stage underflow product withdrawal rate.

In some embodiments of the fourth exemplary aspect, the differential between the first stage underflow product withdrawal rate and the third stage underflow product withdrawal rate may be no greater than about the first stage overflow product withdrawal rate. In some embodiments of the fourth exemplary aspect, the differential between the first stage underflow product withdrawal rate and the third stage underflow product withdrawal rate may be no greater than about an introduction rate of a hydrocarbon diluent into the solvent extraction stages.

In some embodiments of the fourth exemplary aspect, the differential between the second stage underflow product withdrawal rate and the third stage underflow product withdrawal rate may be no greater than about the first stage overflow product withdrawal rate. In some embodiments of the fourth exemplary aspect, the differential between the second stage underflow product withdrawal rate and the third stage underflow product withdrawal rate may be no greater than an introduction rate of a hydrocarbon diluent into the solvent extraction stages.

In some embodiments of the fifth exemplary aspect, the first stage underflow product withdrawal rate may be greater than the final stage underflow product withdrawal rate. In some embodiments of the fifth exemplary aspect, an intermediate stage underflow product withdrawal rate may be greater than the final stage underflow product withdrawal rate.

In some embodiments of the fifth exemplary aspect, the differential between the first stage underflow product withdrawal rate and the final stage underflow product withdrawal rate may be no greater than about the first stage overflow product withdrawal rate. In some embodiments of the third exemplary aspect, the differential between the first stage underflow product withdrawal rate and the final stage underflow product withdrawal rate may be no greater than an introduction rate of a hydrocarbon diluent into the solvent extraction stages.

In some embodiments of the fifth exemplary aspect, the differential between the intermediate stage underflow product withdrawal rate and the final stage underflow product withdrawal rate may be no greater than about the first stage overflow product withdrawal rate. In some embodiments of the third exemplary aspect, the differential between the intermediate stage underflow product withdrawal rate and the final stage underflow product withdrawal rate may be no greater than an introduction rate of a hydrocarbon diluent into the solvent extraction stages.

In some embodiments of the third exemplary aspect, the fourth exemplary aspect and the fifth exemplary aspect, the differential between the underflow component withdrawal rates may be any amount which permits effective management of the solvent extraction stages. In some embodiments of the third exemplary aspect, the fourth exemplary aspect and the fifth exemplary aspect, the differential between the underflow component withdrawal rates may be greater or even much greater than the first stage overflow product withdrawal rate. In some embodiments of the third exemplary aspect, the fourth exemplary aspect and the fifth exemplary aspect, the differential between the underflow component withdrawal rates may be greater than or even much greater than the introduction rate of the hydrocarbon diluent into the solvent extraction stages. In some embodiments, however, differentials above a threshold may result in difficulties in balancing the interfaces between the overflow zones and the underflow zones in the solvent extraction apparatus and may negatively effect the quality of the extract which is produced by the solvent extraction.

BRIEF DESCRIPTION OF DRAWINGS

Embodiments of the invention will now be described with reference to the accompanying drawings, in which:

FIG. 2 is a material balance for a pilot plant test of a portion of the process flow diagram depicted in FIG. 1, in which the feed material is derived from a fine mineral material fraction of froth treatment tailings.

FIG. 3 is a material balance for a pilot plant test of a portion of the process flow diagram depicted in FIG. 1, in which the feed material is derived from a coarse mineral material fraction of froth treatment tailings.

DETAILED DESCRIPTION

Figure 1:
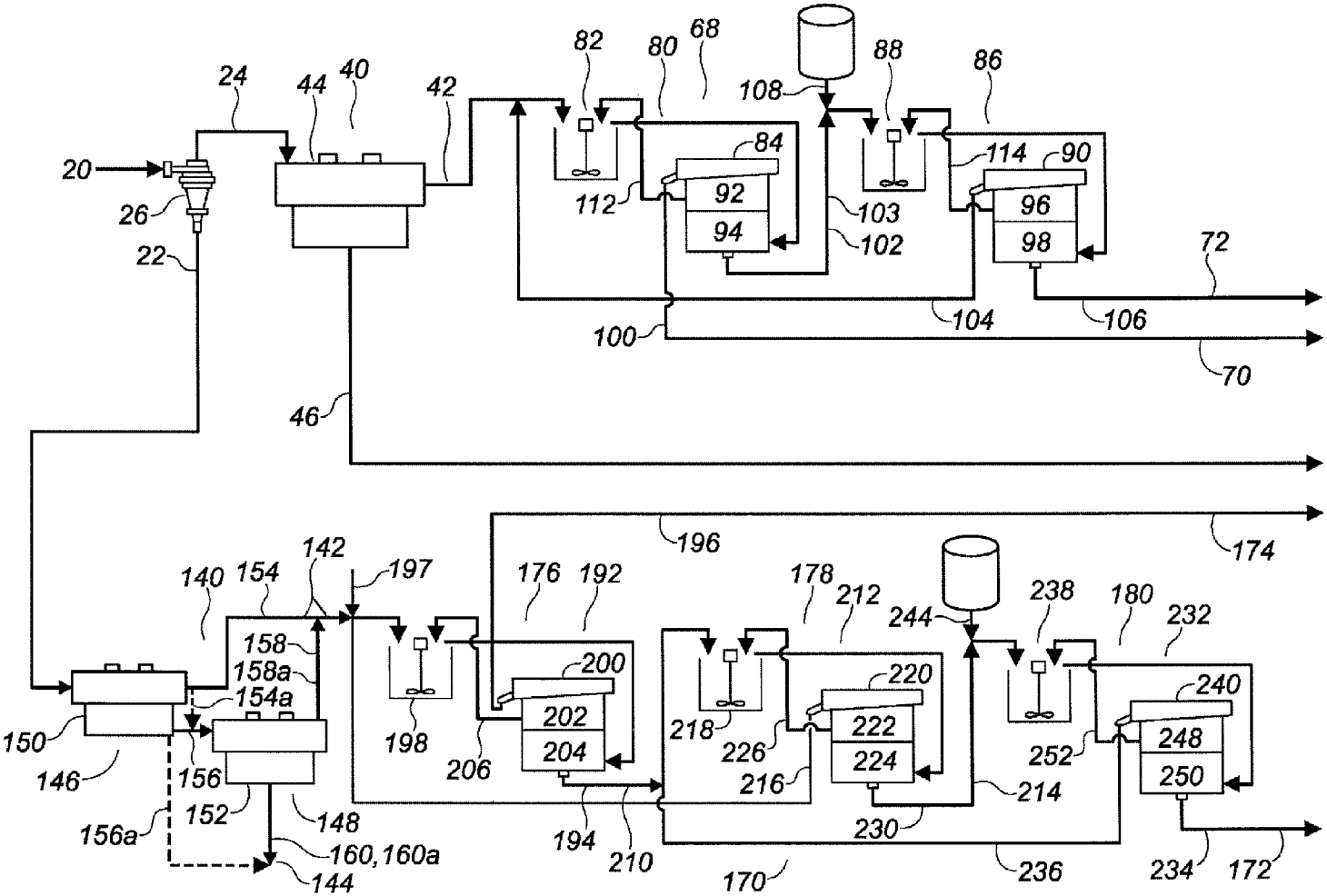
FIG. 1 is a schematic process flow diagram depicting exemplary embodiments of the methods of the invention.

The present invention is directed at methods for separating a feed material comprising solid mineral material, water and bitumen, wherein the feed material is derived from a process for recovering bitumen from oil sands. The feed material may consist of, may consist essentially of, or may be comprised of a bitumen froth, whole froth treatment tailings, a fraction of whole froth treatment tailings, and/or any other suitable material derived from oil sands.

The methods of the invention are solvent extraction methods which are performed in one or more solvent extraction stages.

Exemplary embodiments of the invention are hereafter described with reference to FIG. 1, in which a coarse mineral material fraction and a fine mineral material fraction of froth treatment tailings are both processed using the methods of the invention.

In the exemplary embodiments depicted in FIG. 1, the froth treatment tailings result from a process for recovering bitumen from oil sands. In the exemplary embodiments, the process for recovering bitumen from oil sands is comprised of producing a bitumen froth from the oil sands and is further comprised of separating the froth treatment tailings from the bitumen froth in a froth treatment process.

A typical bitumen froth may be comprised of about 60 percent bitumen, about 30 percent water and about 10 percent solid mineral material by weight. Bitumen froth may therefore be characterized generally as containing, in decreasing order of amount by weight: (1) bitumen; (2) water; and (3) solid mineral material.

Typical froth treatment tailings may be comprised of between about 3 percent and about 12 percent bitumen and froth treatment diluent (if the froth treatment tailings contain a froth treatment diluent), between about 15 percent and about 20 percent solid mineral material, with the balance being comprised primarily of water. Froth treatment tailings may therefore be characterized generally as containing, in decreasing order of amount by weight: (1) water; (2) solid mineral material; and (3) bitumen.

In the exemplary embodiments depicted in FIG. 1, the froth treatment tailings may or may not contain a froth treatment diluent. For example, the froth treatment tailings may result from a froth treatment process in which no froth treatment diluent is used, or the froth treatment tailings may have been subjected to a tailings solvent recovery unit (TSRU) process or a similar process in which substantially all of the froth treatment diluent has been recovered from the froth treatment tailings.

Referring to FIG. 1, a schematic process flow diagram depicting exemplary embodiments of the methods of the invention is provided. In the exemplary embodiments, froth treatment tailings (20) resulting from a froth treatment process (not shown) and comprising solid mineral material, water and an amount of bitumen are first provided. The froth treatment tailings (20) also comprise an amount of a froth treatment diluent which is used in the froth treatment process.

As depicted in FIG. 1, the froth treatment tailings (20) are separated into a coarse mineral material fraction (22) and a fine mineral material fraction (24). As depicted in FIG. 1, the froth treatment tailings (20) are separated using a hydrocyclone (26).

In some embodiments, the separation of the froth treatment tailings (20) may be performed so that the fine mineral material fraction (24) contains between about 0.65 times and about 0.85 times the amount of the bitumen which is contained in the froth treatment tailings (20).

As depicted in FIG. 1, the coarse mineral material fraction (22) and the fine mineral material fraction (24) are separately subjected to further processing in accordance with the exemplary embodiments of the methods of the invention.

The fine mineral material fraction (24) is comprised of solid mineral material, water and an amount of bitumen. The fine mineral material fraction (24) may also be comprised of an amount of froth treatment diluent from the froth treatment tailings (20).

As depicted in FIG. 1, the fine mineral material fraction (24) is first subjected to conditioning (40) in order to produce a first solvent extraction feed material (42) comprised of solid mineral material, water, and an amount of bitumen. The first solvent extraction feed material (42) is also comprised of an amount of froth treatment diluent from the fine mineral material fraction (24).

A purpose of conditioning the fine mineral material fraction (24) is to prepare the fine mineral material fraction (24) for solvent extraction. As depicted in FIG. 1, conditioning (40) the fine mineral material fraction (24) is comprised of agitating the fine mineral material fraction (24) in order to facilitate separation of the bitumen from the solid mineral material.

As depicted in FIG. 1, conditioning (40) the fine mineral material fraction (24) is further comprised of concentrating the fine mineral material fraction (24) so that a concentration of the bitumen by weight in the first solvent extraction feed material (42) is greater than a concentration of the bitumen by weight in the fine mineral material fraction (24).

In some embodiments, concentrating the fine mineral material fraction (24) may be performed so that the concentration of the bitumen by weight in the first solvent extraction feed material (42) is between about 1.25 times and about 3 times the concentration of the bitumen by weight in the fine mineral material fraction (24). In some particular embodiments, concentrating the fine mineral material fraction (24) may be performed so that the concentration of the bitumen by weight in the first solvent extraction feed material (42) is between about 2 times and about 3 times the concentration of the bitumen by weight in the fine mineral material fraction (24).

As depicted in FIG. 1, conditioning (40) the fine mineral material fraction (24), including both agitating the fine mineral material fraction (24) and concentrating the fine mineral material fraction (24) is performed by subjecting the fine mineral material fraction (24) to froth flotation in a froth flotation apparatus (44). As depicted in FIG. 1, the froth flotation apparatus (44) is comprised of an agitator or mixer for agitating the fine mineral material fraction (24) in the froth flotation apparatus (44). Alternatively, the fine mineral material fraction (24) may be passed through a separate agitator or mixer before being subjected to froth flotation in the froth flotation apparatus (44).

Agitating the fine mineral material fraction (24) may be comprised of subjecting the fine mineral material fraction (24) to an agitation intensity, which may be expressed in watts per kilogram of fine mineral material fraction (24) which is agitated. In some embodiments, the agitation intensity may be at least about 25 watts per kilogram. In some embodiments, the agitation intensity may be between about 25 watts per kilogram and about 2000 watts per kilogram. In some embodiments, the agitation intensity may be between about 200 watts per kilogram and about 1500 watts per kilogram. In some embodiments, the agitation intensity may be between about 500 watts per kilogram and about 1200 watts per kilogram.

Agitating the fine mineral material fraction (24) may have an agitation duration, which may be expressed as the length of time for which the fine mineral material fraction (24) is agitated. In some embodiments, the agitation duration may be at least about 5 minutes. In some embodiments, the agitation duration may be at between about 5 minutes and about 40 minutes. In some embodiments, the agitation duration may be between about 5 minutes and about 30 minutes. In some embodiments, the agitation duration may be between about 10 minutes and about 20 minutes.

The froth flotation may have a froth flotation intensity, which may be expressed in kilograms of added air per kilogram of fine mineral material fraction (24) which is subjected to froth flotation. In some embodiments, the froth flotation intensity may be at least about 0.00005 kilograms of added air per kilogram of fine mineral material fraction (24). In some embodiments, the froth flotation intensity may be between about 0.00005 kilograms and about 0.05 kilograms of added air per kilogram of fine mineral material fraction (24). In some embodiments, the froth flotation intensity may be between about 0.01 kilograms and about 0.03 kilograms of added air per kilogram of fine mineral material fraction (24). In some embodiments, the froth flotation intensity may be between about 0.01 and about 0.02 kilograms of added air per kilogram of fine mineral material fraction (24).

The froth flotation may have a froth flotation duration, which may be expressed as the length of time for which the fine mineral material fraction (24) is subjected to froth flotation. In some embodiments, the froth flotation duration may be at least about 5 minutes. In some embodiments, the froth flotation duration may be between about 5 minutes and about 40 minutes. In some embodiments, the froth flotation duration may be between about 5 minutes and about 30 minutes. In some embodiments, the froth flotation duration may be between about 10 minutes and about 20 minutes.

Conditioning the fine mineral material fraction (24) may be performed at any suitable temperature. In some embodiments, conditioning the fine mineral material fraction (24) may be performed so that the fine mineral material fraction (24) has a temperature of between about 40 degrees Celsius and about 95 degrees Celsius.

Conditioning the fine mineral material fraction (24) in the froth flotation apparatus (44) produces the first solvent extraction feed material (42) as an overflow product and produces froth flotation tailings (46) as an underflow product. The froth flotation tailings (46) may be disposed of in any suitable manner.

In some embodiments, conditioning the fine mineral material fraction (24) may be performed so that the first solvent extraction feed material (42) contains between about 0.6 times and about 0.95 times the amount of the bitumen which is contained in the fine mineral material fraction (24). In some particular embodiments in which conditioning the fine mineral material fraction (24) is comprised of subjecting the fine mineral material fraction (24) to froth flotation, the first solvent extraction feed material (42) may contain as much as about 0.95 times the amount of the bitumen which his contained in the fine mineral material fraction (24).

The first solvent extraction feed material (42) is subjected to solvent extraction (68) in order to produce an extract (70) and a raffinate (72).

The solvent extraction (68) may be performed at any suitable temperature. In some embodiments, the solvent extraction (68) may be performed so that the solvent extraction feed material has a temperature of between about 40 degrees Celsius and about 95 degrees Celsius.

The solvent extraction (68) may be performed using a diluent as a solvent. The diluent may be comprised of a hydrocarbon diluent which is introduced into the solvent extraction and/or the diluent may be comprised of residual froth treatment diluent which is contained in the froth treatment tailings (20) as a result of the froth treatment process.

As depicted in FIG. 1, an amount of a hydrocarbon diluent is introduced to the solvent extraction (68). The hydrocarbon diluent may consist of, may consist essentially of, or may be comprised of any suitable naphthenic type diluent or any suitable paraffinic type diluent. The amount of the hydrocarbon diluent (108) which is introduced into the solvent extraction (68) may be expressed as an introduction rate of the hydrocarbon diluent (108).

In embodiments in which the hydrocarbon diluent is comprised of a paraffinic type diluent, the amount of the paraffinic type diluent is preferably selected so that the precipitation of asphaltenes is minimized and so that the recovery of bitumen is maximized.

In some particular embodiments in which the hydrocarbon diluent is comprised of a naphthenic type diluent, the hydrocarbon diluent may be comprised of or consist of naphtha or toluene. In some particular embodiments in which the hydrocarbon diluent is comprised of or consists of naphtha, the naphtha may have an aromaticity of between about 10 and 20 percent.

The performance of toluene as the hydrocarbon diluent in the solvent extraction (68) and the performance of naphtha as the hydrocarbon diluent in the solvent extraction (68) may be dependent upon the diluent to feed material ratio by weight, upon the diluent to bitumen ratio by weight, upon the temperature at which the solvent extraction (68) is performed, and upon the length of time for which the solvent extraction (68) is performed.

At equivalent values of diluent to feed material ratio by weight and equivalent temperatures, the extent of recovery of bitumen in the solvent extraction (68) may generally be greater if the hydrocarbon diluent consists of toluene than if the hydrocarbon diluent consists of naphtha.

In embodiments in which the hydrocarbon diluent consists essentially of toluene, the extent of recovery of bitumen in the solvent extraction (68) may be relatively insensitive to the diluent to feed material ratio by weight.

In embodiments in which the hydrocarbon diluent consists essentially of naphtha, the extent of recovery of bitumen in the solvent extraction (68) may be maximized if the diluent to feed material ratio by weight is relatively low (i.e., less than or equal to about 0.5).

In embodiments in which the hydrocarbon diluent consists essentially of naphtha, the water concentration in the extract (70) produced by the solvent extraction (68) may decrease as the temperature at which the solvent extraction (68) is performed increases if the diluent to feed material ratio by weight is relatively low (i.e., less than or equal to about 0.5).

In embodiments in which an amount of a froth treatment diluent is introduced into the solvent extraction (68), the hydrocarbon diluent is preferably selected having regard to the composition of the froth treatment diluent.

As a first consideration, in some applications it may be convenient for the composition of the froth treatment diluent and the composition of the hydrocarbon diluent to be similar.

However, as a second consideration, the use of a paraffinic type diluent as the hydrocarbon diluent where the solvent extraction feed material is comprised of an amount of a paraffinic type diluent as the froth treatment diluent may not be effective to recover precipitated asphaltenes, unless the concentration of the hydrocarbon diluent during the solvent extraction (68) can be maintained below the critical level which results in significant asphaltene precipitation. Stated otherwise, the use of a paraffinic type diluent as the hydrocarbon diluent may be reasonably effective for recovering non-asphaltenic bitumen material, but may be less effective for recovering asphaltenes.

As a result, where the solvent extraction feed material is comprised of an amount of a naphtha type diluent as the froth treatment diluent, the hydrocarbon diluent may also be comprised of a naphtha type diluent, since asphaltene precipitation is not a major concern. Where the solvent extraction feed material is comprised of an amount of a naphtha type diluent as the froth treatment diluent, the hydrocarbon diluent may be comprised of a paraffinic type diluent if recovery of asphaltenes is not essential or if the concentration of the paraffinic type diluent can be maintained below the critical level which results in significant asphaltene precipitation. Where the solvent extraction feed material is comprised of an amount of a paraffinic type diluent as the froth treatment diluent, the hydrocarbon diluent may be comprised of a naphtha type diluent, since the naphtha type diluent may facilitate the recovery of asphaltenes. Where the solvent extraction feed material is comprised of an amount of a paraffinic type diluent, the hydrocarbon diluent may be comprised of a paraffinic type diluent if recovery of asphaltenes is not essential or if the concentration of the paraffinic type diluent can be maintained below the critical level which results in significant asphaltene precipitation.

As depicted in FIG. 1, the solvent extraction (68) is performed using two stages of solvent extraction and solvent extraction apparatus which are arranged in a countercurrent configuration.

As depicted in FIG. 1, the first stage solvent extraction apparatus (80) is comprised of a first mixer (82) and a first gravity settler (84) and the second stage solvent extraction apparatus (86) is comprised of a second mixer (88) and a second gravity settler (90). As depicted in FIG. 1, each of the gravity settlers (84, 90) is comprised of a gravity settling vessel.

The first solvent extraction feed material (42) is delivered to the first mixer (82) for mixing and is then delivered to the first gravity settler (84). The first solvent extraction feed material (42) separates in the first gravity settler (84) into an overflow zone (92) and an underflow zone (94), with an interface therebetween. A first stage overflow product (100) is withdrawn from the overflow zone (92) and a first stage underflow product (102) is withdrawn from the underflow zone (94).

As depicted in FIG. 1, a second intra-stage recycle component (114) is withdrawn from the overflow zone (96) of the second gravity settler (90) and is combined with the second solvent extraction feed material (103) in order to recycle the second intra-stage recycle component (114) to the second solvent extraction stage. In the embodiments depicted in FIG. 1, a second intra-stage recycle ratio by weight of the second intra-stage recycle component (114) to the second solvent extraction feed material (103) may be between about 0.1 and about 1.5, or may be between about 0.5 and about 1.

The first stage underflow product (102) is delivered to the second mixer (88) for mixing and is then delivered to the second gravity settler (90) as a second solvent extraction feed material (103). The second solvent extraction feed material (103) separates in the second gravity settler (90) into an overflow zone (96) and an underflow zone (98), with an interface therebetween. A second stage overflow product (104) is withdrawn from the overflow zone (96) and a second stage underflow product (106) is withdrawn from the underflow zone (98).

As depicted in FIG. 1, a second intra-stage recycle component (114) is withdrawn from the overflow zone (96) of the second gravity settler (90) and is combined with the second solvent extraction feed material (103) in order to recycle the second intra-stage recycle component (114) to the second solvent extraction stage. In the embodiments depicted in FIG. 1, a second intra-stage recycle ratio by weight of the second intra-stage recycle component (113) to the second solvent extraction feed material (103) may be between about 0.1 and about 1.5, or may be between about 0.5 and about 1.

An amount of a hydrocarbon diluent (108) is also delivered to the second mixer (88) for mixing with the first stage underflow product (102). The hydrocarbon diluent (108) is typically selected having regard to the composition of the froth treatment diluent.

The amount of the hydrocarbon diluent (108) which is delivered to the second mixer (88) may be selected to provide a desired diluent to feed material ratio by weight in the second stage solvent extraction apparatus (86). Alternatively, the amount of hydrocarbon diluent (108) which is delivered to the second mixer (88) may be selected to provide a desired diluent to bitumen ratio by weight in the second stage solvent extraction apparatus (86).

In some particular embodiments, the desired diluent to feed material ratio by weight and/or the desired diluent to bitumen ratio by weight in the second stage solvent extraction apparatus (86) may be greater than the desired diluent to feed material ratio by weight and/or the desired diluent to bitumen ratio by weight in the first stage solvent extraction apparatus (80).

The diluent to feed material ratio may be determined having regard to both the composition and the amount of the froth treatment diluent which is included in the solvent extraction feed material.

In some embodiments in which the hydrocarbon diluent (108) and the froth treatment diluent consist essentially of a naphthenic type diluent, the first stage of solvent extraction may be performed at a diluent to bitumen ratio of generally between about 1 and about 10 by weight, and the second stage of solvent extraction may be performed at a diluent to bitumen ratio of generally between about 5 and about 100 by weight.

In some embodiments in which the hydrocarbon diluent (108) and the froth treatment diluent consist essentially of a naphthenic type diluent, the first stage of solvent extraction may be performed at a diluent to feed material ratio of generally between about 0.09 and about 1 by weight, and the second stage of solvent extraction may be performed at a diluent to feed material ratio of generally between about 0.1 and about 1 by weight.

In some embodiments in which the hydrocarbon diluent (108) and the froth treatment diluent consist essentially of naphtha as a naphthenic type diluent, the first stage of solvent extraction may be performed at a diluent to feed material ratio of between about 0.09 and about 0.75 by weight, between about 0.09 and about 0.5 by weight, or between about 0.09 and about 0.25 by weight.

In some embodiments in which the hydrocarbon diluent (108) and the froth treatment diluent consist essentially of naphtha as a naphthenic type diluent, the second stage of solvent extraction may be performed at a diluent to feed material ratio of between about 0.1 and about 1 by weight, between about 0.1 and about 0.5 by weight, or between about 0.1 and about 0.3 by weight.

In some embodiments in which the hydrocarbon diluent (108) and the froth treatment diluent consist essentially of toluene as a naphthenic type diluent, the first stage of solvent extraction may be performed at a diluent to feed material ratio of between about 0.1 and about 0.9 by weight, between about 0.1 and about 0.5 by weight, or between about 0.2 and about 0.4 by weight.

In some embodiments in which the hydrocarbon diluent (108) and the froth treatment diluent consist essentially of toluene as a naphthenic type diluent, the second stage of solvent extraction may be performed at a diluent to feed material ratio of between about 0.1 and about 1 by weight, between about 0.2 and about 0.5 by weight, or between about 0.2 and about 0.5 by weight.

Although naphtha and toluene are both naphthenic type diluents, the performance of naphtha in the solvent extraction (68) may be more sensitive to the diluent to feed material ratio than is the performance of toluene in the solvent extraction (68). In particular, and as described above, in some embodiments in which the hydrocarbon diluent (108) and the froth treatment diluent consist essentially of naphtha as a naphthenic type diluent, the extent of recovery of bitumen from the solvent extraction feed material may be maximized and the solid mineral material concentration in the extract (70) may be minimized by providing a diluent to feed material ratio which is relatively low (i.e. less than or equal to about 0.5).

In some embodiments in which the hydrocarbon diluent (108) and the froth treatment diluent consist essentially of a paraffinic type diluent, the solvent extraction (68) may be performed under conditions in which the diluent to feed material ratio by weight may be less than a diluent to feed material ratio which will result in significant asphaltene precipitation.

The second stage overflow product (104) is recycled to the first mixer (82). The second stage underflow product (106) is the raffinate (72) and may be disposed of in any suitable manner. The first stage overflow product (100) is the extract (70).

The first stage overflow product (100) is withdrawn from the overflow zone (92) at a first stage overflow product withdrawal rate. The first stage underflow product (102) is withdrawn from the underflow zone (94) at a first stage underflow product withdrawal rate. The second stage overflow product (104) is withdrawn from the overflow zone (96) at a second stage overflow product withdrawal rate. The second stage underflow product (106) is withdrawn from the underflow zone (98) at a second stage underflow product withdrawal rate.

The first stage underflow product withdrawal rate is greater than the second stage underflow product withdrawal rate. As a result, a differential exists between the first stage underflow product withdrawal rate and the second stage underflow product withdrawal rate. In some embodiments as depicted in FIG. 1, the differential between the first stage underflow product withdrawal rate and the second stage underflow product withdrawal rate may be limited so that the differential is no greater than the first stage overflow product withdrawal rate. In some embodiments as depicted in FIG. 1, the differential between the first stage underflow product withdrawal rate and the second stage underflow product withdrawal rate may be limited so that the differential is no greater than the introduction rate of the hydrocarbon diluent (108) into the solvent extraction (68).

The raffinate (72) may be subjected to a solvent recovery process before disposal in order to recover substantially all or a portion of the froth treatment diluent and the hydrocarbon diluent (108) therefrom.

The extract (70) is comprised of solid mineral material, water, and an amount of bitumen. The extract (70) is also comprised of an amount of the froth treatment diluent from the first solvent extraction feed material (42) and an amount of the hydrocarbon diluent (108) which is present in the extract (70) as a result of the recycling of the second stage extraction overflow product (104) to the first mixer (82).

In some embodiments, the extract (70) may contain between about 0.7 times and about 0.95 times the amount of the bitumen which is contained in the first solvent extraction feed material (42). In some embodiments the extract (70) may contain between about 0.6 times and about 0.8 times the amount of the bitumen which is contained in the fine mineral material fraction (24).

The extract (70) has a solid mineral material concentration by weight and a water concentration by weight. If the solid mineral material concentration and the water concentration in the extract (70) are below acceptable limits, the extract (70) may be suitable for further processing and/or transport as a diluted bitumen (i.e., dilbit) product. The further processing of the extract (70) may be comprised of subjecting the extract (70) to a diluent recovery process (not shown) for recovering substantially all or a portion of the froth treatment diluent and the hydrocarbon diluent (108) therefrom.

If however, the solid mineral material concentration and/or the water concentration by weight in the extract (70) are above acceptable limits, the extract (70) may optionally be subjected to clarifying (not shown) in order to produce a clarified extract (120) which has a reduced solid mineral material concentration by weight and/or water concentration by weight in comparison with the extract (70).

The froth flotation tailings (46) and the raffinate (72) may similarly be subjected to a diluent recovery process (not shown) in order to recover substantially all or a portion of the froth treatment diluent and the hydrocarbon diluent (108) therefrom.

The coarse solid material fraction (22) is comprised of solid mineral material, water, and an amount of bitumen. A large proportion of the heavy minerals which are originally contained in the froth treatment tailings (20) will typically be present as coarse solid mineral material in the coarse solid material fraction (22).

The coarse solid material fraction (22) may also be comprised of an amount of froth treatment diluent from the froth treatment tailings (20).

Where the coarse solid material fraction (22) is comprised of a froth treatment diluent, the froth treatment diluent may be comprised of a naphthenic type diluent and/or a paraffinic type diluent, depending upon the type of froth treatment process from which the froth treatment tailings (20) were obtained.

Although the froth treatment tailings (20) may be obtained from a paraffinic froth treatment process so that the coarse solid material fraction (22) may be comprised of a paraffinic type diluent as a froth treatment diluent, the processing of the coarse solid material fraction (22) may be more effective if the froth treatment tailings (20) have been produced by a naphthenic froth treatment process than if the froth treatment tailings (20) have been produced by a paraffinic froth treatment process.

A reason for this is that froth treatment tailings (20) from a paraffinic froth treatment process may typically contain relatively larger amounts of bitumen than froth treatment tailings (20) from a naphthenic froth treatment process. In addition, the bitumen contained in froth treatment tailings (20) from a paraffinic froth treatment process typically includes a relatively large proportion of asphaltenes.

The amount and nature of the bitumen which is typically contained in froth treatment tailings (20) from a paraffinic froth treatment process presents processing challenges which may require more aggressive and/or rigorous process conditions for processing the coarse mineral material fraction (22) than if the froth treatment tailings (22) have been produced from a naphthenic froth treatment process.

As depicted in FIG. 1, the coarse mineral material fraction (22) is first subjected to froth flotation (140) in order to produce a first solvent extraction feed material (142) and froth flotation tailings (144) therefrom.

As depicted in FIG. 1, the froth flotation (140) is comprised of a first froth flotation stage (146) and a second froth flotation stage (148). As depicted in FIG. 1, the first froth flotation stage (146) is performed in a first flotation vessel (150) and the second froth flotation stage (148) is performed in a second flotation vessel (152).

As depicted in FIG. 1, both the first froth flotation stage (146) and the second froth flotation stage (148) are performed in the presence of a suitable amount of an injected gas such as air (not shown) and in the presence of a suitable amount of a suitable frothing agent (not shown). Non-limiting examples of potentially suitable frothing agents include glycol based frothers and/or alcohol based frothers.

The concentration of the frothing agent in the coarse solid material fraction (22) may be any concentration which his suitable for encouraging the formation of a froth layer. In some embodiments, the concentration of the frothing agent may be less than or equal to about 200 grams of frothing agent per tonne of solid mineral material which is included in the coarse solid material fraction (22). In some embodiments, the concentration of the frothing agent may be less than or equal to about 100 grams per tonne of solid mineral material which is included in the coarse solid material fraction (22). In some embodiments, the concentration of the frothing agent may be between about 15 grams and about 50 grams per tonne of solid mineral material which is included in the coarse solid material fraction (22).

As a specific non-limiting example, in the embodiments depicted in FIG. 1, a suitable frothing agent may be Cytec™ F-507 frother, a product of Cytec Industries Inc., and may be added to the feed material to provide a frothing agent concentration of between about 15 grams and about 50 grams per tonne of feed material in each of the froth flotation stages (146,148).

The froth flotation stages (146,148) may be arranged in a scavenging configuration or in a cleaning configuration. The scavenging configuration of the froth flotation (140) is depicted by solid lines in FIG. 1. The cleaning configuration of the froth flotation (140) is depicted by dashed lines in FIG. 1.

In the scavenging configuration of the froth flotation (140), the first froth flotation stage (146) is a rougher froth flotation stage and the second froth flotation stage (148) is a scavenger froth flotation stage so that subjecting the coarse mineral material fraction (22) to froth flotation (140) is comprised of subjecting the coarse mineral material fraction (22) to the rougher froth flotation stage in order to produce a rougher stage float product (154) and a rougher stage sink product (156), and is further comprised of subjecting the rougher stage sink product (156) to the scavenger froth flotation stage in order to produce a scavenger stage float product (158) and a scavenger stage sink product (160).

In the scavenging configuration of the froth flotation (140) as depicted in FIG. 1, the rougher stage float product (154) and the scavenger stage float product (158) are combined so that the first solvent extraction feed material (142) is comprised of or consists essentially of the rougher stage float product (154) and the scavenger stage float product (158), and the froth flotation tailings (144) are comprised of or consist essentially of the scavenger stage sink product (160).

In the scavenging configuration of the froth flotation (140), subjecting the rougher stage sink product (156) to the scavenger froth flotation stage may be comprised of adding an amount of a collector (not shown) to the rougher stage sink product (156) in order to enhance the recovery of heavy minerals in the scavenger stage float product (158). In the embodiments depicted in FIG. 1, the collector may be comprised of a hydrocarbon liquid such as kerosene, naphtha or a mixture thereof. It is believed that the collector adheres to heavy minerals which have amounts of bitumen attached thereto, thereby increasing the hydrophobicity and floatability of the heavy minerals.

The concentration of the collector in the rougher stage sink product (156) may be any concentration which is suitable for collecting the heavy minerals which are contained in the rougher stage sink product (156) without interfering significantly with the production of the froth layer in the scavenger froth flotation stage. In some embodiments, the concentration of the collector in the rougher stage sink product (156) may be less than or equal to about 10 liters per tonne of solid mineral material which is included in the rougher stage sink product (156). In some embodiments, the concentration of the collector in the rougher stage sink product (156) may be less than or equal to about 1 liter per tonne of solid mineral material which is included in the rougher stage sink product (156).

In the scavenging configuration of the froth flotation (140) as depicted in FIG. 1, the rougher froth flotation stage and the scavenger froth flotation stage are performed so that the residence time of the coarse mineral material fraction in the rougher froth flotation stage is longer than the residence time of the rougher stage sink product in the scavenger froth flotation stage. For example, in some applications of the method of the invention, the residence time of the coarse mineral material fraction in the rougher froth flotation stage may be about 10 minutes and the residence time of the rougher stage sink product in the scavenger froth flotation stage may be about 5 minutes.

In the cleaning configuration of the froth flotation (140), the first froth flotation stage (146) is a rougher froth flotation stage and the second froth flotation stage (148) is a cleaner froth flotation stage so that subjecting the coarse mineral material fraction (22) to froth flotation (140) is comprised of subjecting the coarse mineral material fraction (22) to the rougher froth flotation stage in order to produce a rougher stage float product (154*a*) and a rougher stage sink product (156*a*), and is further comprised of subjecting the rougher stage float product (154*a*) to the cleaner froth flotation stage in order to produce a cleaner stage float product (158*a*) and a cleaner stage sink product (160*a*).

In the cleaning configuration of the froth flotation (140) as depicted in Figure the first solvent extraction feed material (142) is comprised of or consists essentially of the cleaner stage float product (158*a*). Furthermore, in the cleaning configuration of the froth flotation (140) as depicted in FIG. 1, the rougher stage sink product (156*a*) and the cleaner stage sink product (160*a*) are combined so that the froth flotation tailings (144) are comprised of or consist essentially of the rougher stage sink product (156*a*) and the cleaner stage sink product (160*a*).

In the embodiments of both the scavenging configuration and the cleaning configuration of the froth flotation (140) as described above, the coarse mineral material fraction (22) may have a solid mineral material concentration of between about 20 percent and about 80 percent by weight of the coarse mineral material fraction (22) when the coarse mineral material fraction (22) is introduced to the froth flotation (140) or more particularly, when the coarse mineral material fraction (22) is introduced to the first froth flotation stage (146).

A purpose of the froth flotation (140) is to concentrate the heavy minerals by rejecting the froth flotation tailings (144) in order to produce the first solvent extraction feed material (142). The first solvent extraction feed material (142) has a substantially smaller volume than the coarse mineral material fraction (22) and can therefore be processed more efficiently than the coarse mineral material fraction (22).

Following the froth flotation (140), the first solvent extraction feed material (142) is subjected to solvent extraction (170) in order to produce therefrom a raffinate (172) comprising a heavy mineral concentrate with reduced bitumen content and an extract (174) containing bitumen.

The first solvent extraction feed material (142) has a solid mineral material concentration. The first solvent extraction feed material (142) may have any solid mineral material concentration which is suitable for conducting the solvent extraction (170). In some embodiments, the first solvent extraction feed material (142) may have a solid mineral material concentration which is lower than a solid mineral material concentration which will interfere with the recovery of the extract (174). In some embodiments, the first solvent extraction feed material (142) may have a solid mineral material concentration of at least about 20 percent by weight of the first solvent extraction feed material (142) when it is introduced to the solvent extraction (170). In some embodiments, the first solvent extraction feed material (142) may have a solid mineral material concentration of less than or equal to about 80 percent by weight of the first solvent extraction feed material (142) when it is introduced to the solvent extraction (170). In some embodiments, the first solvent extraction feed material (142) may have a solid mineral material concentration of less than or equal to about 70 percent by weight of the first solvent extraction feed material (142) when it is introduced to the solvent extraction (170). In some embodiments, the first solvent extraction feed material (142) may have a solid mineral material concentration of between about 20 percent and 70 percent by weight of the first solvent extraction feed material (142) when it is introduced to the solvent extraction (170).

The bitumen content of the solvent extraction feed material will typically decrease as the number of stages of solvent extraction (170) increases, so that the solvent extraction feed material is progressively cleaned of bitumen by the stages of solvent extraction. In some embodiments, the number of stages of solvent extraction (170) may be selected so that the bitumen concentration of the raffinate (172) is no greater than a desired limit which will facilitate subsequent processing of the raffinate (172) to recover the heavy minerals therefrom.

In some embodiments, the desired limit of the bitumen concentration in the raffinate (172) may be about 0.5 percent bitumen by weight of the raffinate (172).

As depicted in FIG. 1, the solvent extraction (170) is comprised of a first solvent extraction stage (176), a second solvent extraction stage (178) and a third solvent extraction stage (180).

As depicted in FIG. 1, the solvent extraction stages (176,178,180) are arranged in a countercurrent configuration. As a result, the extract (174) is produced from the first solvent extraction stage (176) and the raffinate (172) is produced from the third solvent extraction stage (180).

The first solvent extraction stage (176) is comprised of attritioning the first solvent extraction feed material (142) in order to produce an attritioned first solvent extraction feed material (192). The first solvent extraction stage (176) is further comprised of separating the attritioned first solvent extraction feed material (192) in order to produce a first stage underflow product (194) and a first stage overflow product (196).

As depicted in FIG. 1, the first solvent extraction feed material (142) may have a solid mineral material concentration of between about 20 percent and about 70 percent by weight of the first solvent extraction feed material (142). The first solvent extraction feed material (142) may be comprised of an amount of make-up water (197) to provide a desired solid mineral material concentration for the first solvent extraction feed material (142). The make-up water (197) may be comprised of or may consist essentially of fresh water and/or water which is recycled from the methods of the invention or from other processes.

As depicted in FIG. 1, the attritioning of the first solvent extraction feed material (142) is performed by mixing the first solvent extraction feed material (142) in a first mixer (198). A purpose of the attritioning is to liberate bitumen from the first solvent extraction feed material (142) so that the bitumen can more effectively be separated from the heavy minerals in the separating of the attritioned first solvent extraction feed material (192). Another purpose of the attritioning is to mix the constituents of the first solvent extraction feed material (142).

As depicted in FIG. 1, the separating of the attritioned first solvent extraction feed material (192) is performed by passing the attritioned first solvent extraction feed material (192) through a first gravity settler (200). As depicted in FIG. 1, the first gravity settler (200) is comprised of a first gravity settling vessel.

The attritioned first solvent extraction feed material (192) separates in the first gravity settler (200) into an overflow zone (202) and an underflow zone (204), with an interface therebetween. The first stage overflow product (196) is withdrawn from the overflow zone (202) and the first stage underflow product (194) is withdrawn from the underflow zone (204).

As depicted in FIG. 1, a first intra-stage recycle component (206) is withdrawn from the overflow zone (202) of the first gravity settler (200) and is combined with the first solvent extraction feed material (142) in order to recycle the first intra-stage recycle component (206) to the first solvent extraction stage. In the embodiments depicted in FIG. 1, a first intra-stage recycle ratio by weight of the first intra-stage recycle component (206) to the attritioned first solvent extraction feed material (192) may be between about 0.1 and 1.5, or may be between about 0.5 and about 1.

As depicted in FIG. 1, the extract (174) is comprised of or consists essentially of the first stage overflow product (196). As depicted in FIG. 1, the first stage underflow product (194) is subjected to the second solvent extraction stage (178) as a second solvent extraction feed material (210).

The second solvent extraction feed material (210) has a solid mineral material concentration. The second solvent extraction feed material (210) may have any solid mineral material concentration which is suitable for conducting the solvent extraction (170). In some embodiments, the second solvent extraction feed material (210) may have a solid mineral material concentration which is lower than a solid mineral material concentration which will interfere with the recovery of the extract (174). In some embodiments, the second solvent extraction feed material (210) may have a solid mineral material concentration of at least about 20 percent by weight of the second solvent extraction feed material (210) when it is introduced to the solvent extraction (170). In some embodiments, the second solvent extraction feed material (210) may have a solid mineral material concentration of less than or equal to about 80 percent by weight of the second solvent extraction feed material (210) when it is introduced to the solvent extraction (170). In some embodiments, the second solvent extraction feed material (210) may have a solid mineral material concentration of less than or equal to about 70 percent by weight of the second solvent extraction feed material (210) when it is introduced to the solvent extraction (170). In some embodiments, the second solvent extraction feed material (210) may have a solid mineral material concentration of between about 20 percent and 70 percent by weight of the second solvent extraction feed material (210) when it is introduced to the solvent extraction (170).

The second solvent extraction stage (178) is comprised of attritioning the second solvent extraction feed material (210) in order to produce an attritioned second solvent extraction feed material (212). The second solvent extraction stage (178) is further comprised of separating the attritioned second solvent extraction feed material (212) in order to produce a second stage underflow product (214) and a second stage overflow product (216).

As depicted in FIG. 1, the second solvent extraction feed material (210) may have a solid mineral material concentration of between about 20 percent and about 70 percent by weight of the second solvent extraction feed material (210).

As depicted in FIG. 1, the attritioning of the second solvent extraction feed material (210) is performed by mixing the second solvent extraction feed material (210) in a second mixer (218). A purpose of the attritioning is to liberate bitumen from the second solvent extraction feed material (210) so that the bitumen can more effectively be separated from the heavy minerals in the separating of the attritioned second solvent extraction feed material (212). Another purpose of the attritioning is to mix the constituents of the second solvent extraction feed material (210).

As depicted in FIG. 1, the separating of the attritioned second solvent extraction feed material (212) is performed by passing the attritioned second solvent extraction feed material (212) through a second gravity settler (220). As depicted in FIG. 1, the second gravity settler (220) is comprised of a second gravity settling vessel.

The attritioned second solvent extraction feed material (212) separates in the second gravity settler (220) into an overflow zone (222) and an underflow zone (224), with an interface therebetween. The second stage overflow product (216) is withdrawn from the overflow zone (222) and the second stage underflow product (214) is withdrawn from the underflow zone (224).

As depicted in FIG. 1, a second intra-stage recycle component (226) is withdrawn from the overflow zone (222) of the second gravity settler (220) and is combined with the second solvent extraction feed material (210) in order to recycle the second intra-stage recycle component (226) to the second solvent extraction stage. In the embodiments depicted in FIG. 1, a second intra-stage recycle ratio by weight of the second intra-stage recycle component (226) to the attritioned second solvent extraction feed material (212) may be between about 0.1 and 1.5, or may be between about 0.5 and about 1.

As depicted in FIG. 1, the second stage overflow product (216) is mixed with the first solvent extraction feed material (142) in the first mixer (198) so that the second stage overflow product (216) is introduced into the first solvent extraction stage (176). As depicted in FIG. 1, the second solvent extraction underflow component (214) is subjected to the third solvent extraction stage (180) as a third solvent extraction feed material (230).

The third solvent extraction feed material (230) has a solid mineral material concentration. The third solvent extraction feed material (230) may have any solid mineral material concentration which is suitable for conducting the solvent extraction (170). In some embodiments, the third solvent extraction feed material (230) may have a solid mineral material concentration which is lower than a solid mineral material concentration which will interfere with the recovery of the extract (174). In some embodiments, the third solvent extraction feed material (230) may have a solid mineral material concentration of at least about 20 percent by weight of the third solvent extraction feed material (230) when it is introduced to the solvent extraction (170). In some embodiments, the third solvent extraction feed material (230) may have a solid mineral material concentration of less than or equal to about 80 percent by weight of the third solvent extraction feed material (230) when it is introduced to the solvent extraction (170). In some embodiments, the third solvent extraction feed material (230) may have a solid mineral material concentration of less than or equal to about 70 percent by weight of the third solvent extraction feed material (230) when it is introduced to the solvent extraction (170). In some embodiments, the third solvent extraction feed material (230) may have a solid mineral material concentration of between about 20 percent and 70 percent by weight of the third solvent extraction feed material (230) when it is introduced to the solvent extraction (170).

The third solvent extraction stage (180) is comprised of attritioning the third solvent extraction feed material (230) in order to produce an attritioned third solvent extraction feed material (232). The third solvent extraction stage (180) is further comprised of separating the attritioned third solvent extraction feed material (232) in order to produce a third stage underflow product (234) and a third stage overflow product (236).

As depicted in FIG. 1, the third solvent extraction feed material (230) may have a solid mineral material concentration of between about 20 percent and about 70 percent by weight of the third solvent extraction feed material (230).

As depicted in FIG. 1, the attritioning of the third solvent extraction feed material (230) is performed by mixing the third solvent extraction feed material (230) in a third mixer (238). A purpose of the attritioning is to liberate bitumen from the third solvent extraction feed material (230) so that the bitumen can more effectively be separated from the heavy minerals in the separating of the attritioned third solvent extraction feed material (232). Another purpose of the attritioning is to mix the constituents of the third solvent extraction feed material (230).

As depicted in FIG. 1, the separating of the attritioned third solvent extraction feed material (232) is performed by passing the attritioned third solvent extraction feed material (232) through a third gravity settler (240). As depicted in FIG. 1, the third gravity settler (240) is comprised of a third gravity settling vessel.

The attritioned third solvent extraction feed material (232) separates in the third gravity settler (240) into an overflow zone (248) and an underflow zone (250), with an interface therebetween. The third stage overflow product (236) is withdrawn from the overflow zone (248) and the third stage underflow product (234) is withdrawn from the underflow zone (250).

As depicted in FIG. 1, a third intra-stage recycle component (252) is withdrawn from the overflow zone (248) of the third gravity settler (240) and is combined with the third solvent extraction feed material (230) in order to recycle the third intra-stage recycle component (252) to the third solvent extraction stage. In the embodiments depicted in FIG. 1, a third intra-stage recycle ratio by weight of the third intra-stage recycle component (252) to the attritioned third solvent extraction feed material (232) may be between about 0.1 and 1.5, or may be between about 0.5 and about 1.

As depicted in FIG. 1, the third stage overflow product (236) is mixed with the first stage underflow product (194) in the second mixer (218) so that the third stage overflow product (236) is introduced into the second solvent extraction stage (178). As depicted in FIG. 1, the raffinate (172) is comprised of or consists essentially of the third stage underflow product (234).

The solvent extraction (170) may be performed using a diluent as a solvent. The diluent may be comprised of a hydrocarbon diluent which is introduced into the solvent extraction (170) and/or the diluent may be comprised of residual froth treatment diluent which is contained in the froth treatment tailings (20) as a result of the froth treatment process.

The diluent may be comprised of or may consist essentially of one or more suitable naphthenic type diluents or may be comprised of a mixture of one or more suitable naphthenic type diluents and/or paraffinic type diluents. The amount of the diluent may be any amount which is effective to facilitate the separation of the solvent extraction feed material in order to produce the raffinate (172) and the extract (174).

In some embodiments in which the diluent may be comprised of a paraffinic type diluent, the paraffinic type diluent may be present in the diluent as a residual amount of a froth treatment diluent which was contained in the froth treatment tailings (20) as a result of a paraffinic froth treatment process. In some embodiments in which the diluent may consist essentially of one or more naphthenic type diluents, some of the naphthenic type diluent may be present in the diluent as a residual amount of a froth treatment diluent which was contained in the froth treatment tailings (20) as a result of a naphthenic froth treatment process.

In some embodiments in which the diluent may be comprised of a paraffinic type diluent, the amount of the paraffinic type diluent may be selected in order to control the amount of asphaltenes which are precipitated during the solvent extraction (170), since precipitated asphaltenes will tend to be included in the raffinate (172) and not in the extract (174). An excessive amount of precipitated asphaltenes contained in the raffinate (172) may interfere with subsequent processing to recover the heavy minerals from the raffinate (172).

In some embodiments in which the diluent may be comprised of a naphthenic type diluent, a suitable diluent may be comprised of or may consist essentially of naphtha or toluene. In some embodiments, the diluent may be comprised of or may consist essentially of naphtha.

The amount of the diluent may be any amount which is suitable for conducting the solvent extraction (170). In some embodiments in which the diluent may be comprised of a naphthenic type diluent, the amount of the diluent may be selected in order to maximize the separation of the solvent extraction feed material into the raffinate (172) and the extract (174).

As depicted in FIG. 1, an amount of a hydrocarbon diluent (244) is combined with the second stage underflow product (214) so that the hydrocarbon diluent (244) is introduced into the third solvent extraction stage (180). As depicted in FIG. 1, the hydrocarbon diluent (244) consists essentially of naphtha. The amount of the hydrocarbon diluent (244) which is introduced into the solvent extraction (170) may be expressed as an introduction rate of the hydrocarbon diluent (244).

As depicted in FIG. 1, the amount of the hydrocarbon diluent (244) is selected so that each of the first solvent extraction stage (176), the second solvent extraction stage (178), and the third solvent extraction stage (180) is performed in the presence of at least about 15 percent by weight of a diluent.

The first stage overflow product (196) is withdrawn from the overflow zone (202) at a first stage overflow product withdrawal rate. The first stage underflow product (194) is withdrawn from the underflow zone (204) at a first stage underflow product withdrawal rate. The second stage overflow product (216) is withdrawn from the overflow zone (222) at a second stage overflow product withdrawal rate.

The second stage underflow product (214) is withdrawn from the underflow zone (224) at a second stage underflow product withdrawal rate. The third stage overflow product (236) is withdrawn from the overflow zone (248) at a third stage overflow product withdrawal rate. The third stage underflow product (234) is withdrawn from the underflow zone (250) at a third stage underflow product withdrawal rate.

At least one of the first stage underflow product withdrawal rate and the second stage underflow product withdrawal rate is greater than the third stage underflow product withdrawal rate. As a result, a differential exists between the first stage underflow product withdrawal rate and/or the second stage underflow product withdrawal rate in comparison with the third stage underflow product withdrawal rate. In some embodiments as depicted in FIG. 1, the differential between the first stage underflow product withdrawal rate and/or the second stage underflow product withdrawal rate in comparison with the third stage underflow product withdrawal rate may be limited so that the differential is no greater than the first stage overflow product withdrawal rate. In some embodiments as depicted in FIG. 1, the differential between the first stage underflow product withdrawal rate and/or the second stage underflow product withdrawal rate in comparison with the third stage underflow product withdrawal rate may be limited so that the differential is no greater than the introduction rate of the hydrocarbon diluent (244) into the solvent extraction (170).

In some embodiments, the processing of the coarse mineral material fraction (22) may be capable of producing a raffinate (172) which has a bitumen concentration which is no greater than about 0.5 percent by weight of the raffinate (172). In some embodiments, the processing of the coarse mineral material fraction (22) may be capable of producing a raffinate (172) which has a bitumen concentration which is no greater than about 0.5 percent of the dry weight of the raffinate (172), where the dry weight of the raffinate (172) is the weight of the raffinate (172) excluding water.

In some embodiments, the processing of the coarse mineral material fraction (22) may be capable of producing an extract (174) which has a water concentration which is no greater than about 0.5 percent by weight of the extract (174). In some embodiments, the processing of the coarse mineral material fraction (22) may be capable of producing an extract (174) which has a solid mineral material concentration which is no greater than about 0.5 percent by weight of the extract (174). In some embodiments, the processing of the coarse mineral material fraction (22) may be capable of producing an extract (174) which has a combined solid mineral material and water concentration which is no greater than about 1.0 percent by weight of the extract (174), or in some embodiments no greater than about 0.5 percent by weight of the extract (174).

In some embodiments, the processing of the coarse mineral material fraction (22) may be capable of recovering in the first solvent extraction feed material (142) at least about 90 percent of the heavy minerals which are contained in the coarse mineral material fraction (22) by weight of the coarse mineral material fraction (22). In some embodiments, the processing of the coarse mineral material fraction (22) may be capable of recovering in the first solvent extraction feed material (142) at least about 95 percent of the heavy minerals which are contained in the coarse mineral material fraction (22) by weight of the coarse mineral material fraction (22). In some embodiments, the processing of the coarse mineral material fraction (22) may be capable of recovering in the first solvent extraction feed material (142) at least about 80 percent of the bitumen which is contained in the coarse mineral material fraction (22) by weight of the coarse mineral material fraction (22).

In some embodiments, the processing of the coarse mineral material fraction (22) may be capable of recovering in the extract (174) at least about 80 percent of the bitumen which is contained in the coarse mineral material fraction (22) by weight of the coarse mineral material fraction (22). In some embodiments, the processing of the coarse mineral material fraction (22) may be capable of recovering in the extract (174) at least about 85 percent of the bitumen which is contained in the coarse mineral material fraction (22) by weight of the coarse mineral material fraction (22). In some embodiments, the processing of the coarse mineral material fraction (22) may be capable of recovering at least about 90 percent of the bitumen which is contained in the coarse mineral material fraction (22) by weight of the coarse mineral material fraction (22).

Following the solvent extraction (170), the extract (174) may be further processed and/or may be stored or transported for further processing. It may also be desirable to subject the extract (174) to a diluent recovery process (not shown) in order to recover at least a portion of the diluent from the extract (174) in order to facilitate recycling of the diluent before processing, storing and/or transporting the extract (174).

In some embodiments, all or a portion of the extract (174) may be provided to the solvent extraction (68) relating to the fine mineral material fraction (24) to provide or to supplement the hydrocarbon diluent (108) which is added in the solvent extraction (68). Providing all or a portion of the extract (174) to the solvent extraction (68) may reduce the amount of fresh hydrocarbon diluent (108) which must be added in the solvent extraction (68).

Following the solvent extraction (170), the raffinate (172) may be further processed to recover the heavy minerals which are contained therein. It may also be desirable to subject the raffinate (172) to a diluent recovery process (not shown) in order to reduce the diluent concentration of the raffinate (172) before attempting to recover the heavy minerals therefrom.

Referring to FIG. 2, a material balance for a pilot plant scale experiment is provided for a method for processing a fine mineral material fraction (24) of froth treatment tailings (20) in accordance with the methods of the invention. Referring to FIG. 3, a material balance for a pilot plant scale experiment is provided for a method for processing a coarse mineral material fraction (22) of froth treatment tailings (20) in accordance with methods of the invention.

Referring to FIG. 2, the first stage underflow product withdrawal rate is 3.10 kilograms per minute, the second stage underflow product withdrawal rate is 2.90 kilograms per minute, the first overflow product withdrawal rate is 0.34 kilograms per minute, and the introduction rate of the hydrocarbon diluent (108) is 0.32 kilograms per minute. It is noted that the differential between the first stage underflow product withdrawal rate and the second stage underflow product withdrawal rate is 0.20 kilograms per minute. The differential is therefore less than both the first overflow product withdrawal rate and the introduction rate of the hydrocarbon diluent (108).

Referring to FIG. 3, the first stage underflow product withdrawal rate is 0.44 kilograms per minute, the second stage underflow product withdrawal rate is 0.35 kilograms per minute, the third stage underflow product withdrawal rate is 0.35 kilograms per minute, the first overflow product withdrawal rate is 0.045 kilograms per minute, and the introduction rate of the hydrocarbon diluent (244) is 0.06 kilograms per minute. It is noted that the differential between the first stage underflow product withdrawal rate and the third stage underflow product withdrawal rate is 0.09 kilograms per minute. The differential is therefore greater than both the first overflow product withdrawal rate and the introduction rate of the hydrocarbon diluent (244).

As described herein, the present invention is directed at solvent extraction separation methods. In some embodiments, the present invention is more particularly directed at withdrawing an intra-stage recycle component from one or more solvent extraction stages. In some embodiments, the present invention is more particularly directed at providing that an underflow product withdrawal rate in at least one of the solvent extraction stages other than the final solvent extraction stage is greater than the underflow product withdrawal rate in the final solvent extraction stage so that there is a differential between the underflow product withdrawal rates.

Both of these aspects of the invention are directed toward improving multiphase separation processes which can be complicated by interphase developments such as emulsions, rag layers, sludges, etc. and at improving the separation of the bitumen phase in the solvent extraction stages.

Both of these aspects of the invention may potentially provide improved process efficiencies in that relatively less hydrocarbon diluent may potentially be necessary in the processes and/or the size of the processes may potentially be reduced, by ultimately reducing the amount of hydrocarbon diluent which is required to achieve a desired standard of performance.

In the intra-stage recycle aspect of the invention, providing an intra-stage recycle component creates an opportunity to remove interphase developments such as rag material from the solvent extraction apparatus and transferring such material to a mixer where it may be treated with mechanical energy and potentially be shifted to a new equilibrium that may be less prone to developing such interphase developments. Providing an intra-stage recycle component may also provide a further benefit of reducing the solid mineral material concentration in the solvent extraction apparatus, thereby reducing the viscosity of the bitumen phase in the solvent extraction apparatus and potentially improving the separation in the solvent extraction apparatus and potentially improving the quality of the extract produced by the solvent extraction.

In the underflow component withdrawal rate differential aspect of the invention, the relatively higher underflow component withdrawal rate in an upstream solvent extraction stage causes a reduction in the residence time, primarily of the underflow component in the solvent extraction apparatus, which may potentially "draw" some interphase developments such as rag material to the underflow component, thereby potentially reducing an accumulation of rag material in the solvent extraction apparatus.

In the practice of the invention, the phenomenon of rag material accumulation may in some embodiments be controlled by monitoring the fluid density in the solvent extraction apparatus and increasing the underflow component withdrawal rate from the solvent extraction apparatus if the fluid density of the material in the solvent extraction apparatus increases above a desired value. In some embodiments, the fluid density may be monitored by monitoring the fluid density of the intra-stage recycle component.

In the underflow component withdrawal rate differential aspect of the invention, transferring "additional" underflow material to the downstream solvent extraction stage also provides an opportunity for more mechanical energy to be imparted to the potentially problematic underflow material and in a countercurrent process, allows such underflow material to be subjected to an increased hydrocarbon diluent concentration in the downstream solvent extraction stage. This increased hydrocarbon diluent concentration may assist in reducing the amount of rag material (by shifting to a new phase equilibrium), may provide improved settling in the downstream solvent extraction apparatus because of the increased dilution of the material in the downstream solvent extraction apparatus. This may in turn result in an improved quality of the overflow component which is produced in the downstream solvent extraction apparatus. If this improved quality overflow component is recycled back to the previous solvent extraction stage, the improved quality of the overflow component may assist in minimizing interphase development such as rag material in the previous solvent extraction stage.

In the underflow component withdrawal rate differential aspect of the invention, maintaining the underflow component withdrawal rate in the final solvent extraction stage at a lower rate relative to the underflow component withdrawal rate in one or more of the upstream solvent extraction stages provides for a relatively greater overflow component withdrawal rate in the final solvent extraction stage. In a countercurrent process, where the overflow component from the final solvent extraction stage is recycled back to the previous solvent extraction stage, the relatively greater overflow component withdrawal rate in the final solvent extraction stage provides an increased opportunity to dilute the material in the previous solvent extraction stage and provides potentially improved separation in the previous solvent extraction stage, which may result in an improved quality of the overflow component in the previous solvent extraction stage by increasing the bitumen phase residence time in the previous solvent extraction stage.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A separation method, the method comprising:

(a) providing a first stage solvent extraction apparatus comprising a first mixer and a first gravity settler, for performing a first solvent extraction stage;

(b) introducing a first solvent extraction feed material into the first mixer, wherein the first solvent extraction feed material is comprised of solid mineral material, water and bitumen, wherein the first solvent extraction feed material is derived from a process for recovering bitumen from oil sands, and wherein the first solvent extraction feed material comprises whole froth treatment tailings or a fraction of whole froth treatment tailings;

(c) allowing the first solvent extraction feed material to separate in the first gravity settler into an underflow zone and an overflow zone;

(d) withdrawing a first stage underflow product from the underflow zone of the first gravity settler;

(e) withdrawing a first stage overflow product from the overflow zone of the first gravity settler;

(f) withdrawing a first intra-stage recycle component comprising bitumen from the overflow zone of the first gravity settler; and (g) mixing the entire first intra-stage recycle component with the first solvent extraction feed material in the first mixer;

(h) introducing the first stage underflow product into a second solvent extraction stage as a second solvent extraction feed material;

(i) allowing the second solvent extraction feed material to separate in the second solvent extraction stage into an underflow zone and an overflow zone;

(j) withdrawing a second stage underflow product from the underflow zone of the second solvent extraction stage; and (k) withdrawing a second stage overflow product from the overflow zone of the second solvent extraction stage; and (l) mixing the second stage overflow product with the first intra-stage recycle component and the first solvent extraction feed material in the first mixer so that allowing the first solvent extraction feed material to separate in the first gravity settler comprises allowing the mixed second stage overflow product, first intra-stage recycle component and first solvent extraction feed material to separate in the first gravity settler.

2. The method as claimed in claim 1, further comprising mixing an amount of a hydrocarbon diluent with the second stage overflow product, the first intra-stage recycle component and the first solvent extraction feed material in the first mixer.

3. The method as claimed in claim 2 wherein the hydrocarbon diluent is comprised of a naphthenic type diluent.

4. The method as claimed in claim 1 wherein a first intra-stage recycle ratio by weight of the first intra-stage recycle component to the first solvent extraction feed material is between 0.1 and 1.5.

5. The method as claimed in claim 4 wherein the first intra-stage recycle ratio is between 0.5 and 1.

6. The method as claimed in claim 1 wherein the first solvent extraction feed material is comprised of an upstream underflow product from an upstream solvent extraction stage.

7. The method as claimed in claim 1, further comprising:

(a) withdrawing a second intra-stage recycle component comprising bitumen from the overflow zone of the second solvent extraction stage; and (b) mixing the entire second intra-stage recycle component with the second solvent extraction feed material.

8. The method as claimed in claim 7, further comprising mixing an amount of a hydrocarbon diluent with the second intra-stage recycle component and the second solvent extraction feed material.

9. The method as claimed in claim 8 wherein the hydrocarbon diluent is comprised of a naphthenic type diluent.

10. The method as claimed in claim 7 wherein a second intra-stage recycle ratio by weight of the second intra-stage recycle component to the second solvent extraction feed material is between 0.1 and 1.5.

11. The method as claimed in claim 10 wherein the second intra-stage recycle ratio is between 0.5 and 1.

12. The method as claimed in claim 1, further comprising:

(a) introducing the second stage underflow product into a third solvent extraction stage as a third solvent extraction feed material;

(b) allowing the third solvent extraction feed material to separate in the third solvent extraction stage into an underflow zone and an overflow zone;

(c) withdrawing a third stage underflow product from the underflow zone of the third solvent extraction stage; and (d) withdrawing a third stage overflow product from the overflow zone of the third solvent extraction stage.

13. The method as claimed in claim 12, further comprising:

(a) withdrawing a third intra-stage recycle component comprising bitumen from the overflow zone of the third solvent extraction stage; and (b) mixing the entire third intra-stage recycle component with the third solvent extraction feed material.

14. The method as claimed in claim 13, further comprising mixing an amount of a hydrocarbon diluent with the third intra-stage recycle component and the third solvent extraction feed material.

15. The method as claimed in claim 14 wherein the hydrocarbon diluent is comprised of a naphthenic type diluent.

16. The method as claimed in claim 14, further comprising mixing the third stage overflow product with the second solvent extraction feed material.

17. The method as claimed in claim 13 wherein a third intra-stage recycle ratio by weight of the third intra-stage recycle component to the third solvent extraction feed material is between 0.1 and 1.5.

18. The method as claimed in claim 17 wherein the third intra-stage recycle ratio is between 0.5 and 1.

19. The method as claimed in claim 7, further comprising:

(a) introducing the second stage underflow product into a third solvent extraction stage as a third solvent extraction feed material;

(b) allowing the third solvent extraction feed material to separate in the third solvent extraction stage into an underflow zone and an overflow zone;

(c) withdrawing a third stage underflow product from the underflow zone of the third solvent extraction stage; and (d) withdrawing a third stage overflow product from the overflow zone of the third solvent extraction stage.

20. The method as claimed in claim 19, further comprising:

(a) withdrawing a third intra-stage recycle component comprising bitumen from the overflow zone of the third solvent extraction stage; and (b) mixing the entire third intra-stage recycle component with the third solvent extraction feed material.

21. The method as claimed in claim 20, further comprising mixing an amount of a hydrocarbon diluent with the third intra-stage recycle component and the third solvent extraction feed material.

22. The method as claimed in claim 21 wherein the hydrocarbon diluent is comprised of a naphthenic type diluent.

23. The method as claimed in claim 21, further comprising mixing the third stage overflow product with the second solvent extraction feed material.

24. The method as claimed in claim 20 wherein a third intra-stage recycle ratio by weight of the third intra-stage recycle component to the third solvent extraction feed material is between 0.1 and 1.5.

25. The method as claimed in claim 24 wherein the third intra-stage recycle ratio is between 0.5 and 1.

26. A separation method for producing an extract and a raffinate from a solvent extraction feed material comprising solid mineral material, water and bitumen, wherein the solvent extraction feed material is derived from a process for recovering bitumen from oil sands, wherein the solvent extraction feed material comprises whole froth treatment tailings or a fraction of whole froth treatment tailings, wherein the separation method is comprised of a plurality of solvent extraction stages, wherein each of the solvent extraction stages produces from a stage solvent extraction feed material an overflow product from an overflow zone and an underflow product from an underflow zone, and wherein in at least one of the solvent extraction stages:

(a) a stage intra-stage recycle component comprising bitumen is withdrawn from the overflow zone of the solvent extraction stage;

(b) an overflow product is produced from the overflow zone of a solvent extraction stage immediately following the solvent extraction stage;

(c) the stage solvent extraction feed material, the entire stage intra-stage recycle component and the overflow product from the solvent extraction stage immediately following the solvent extraction stage are mixed in a stage mixer; and (d) the mixed stage solvent extraction feed material, stage intra-stage recycle component and overflow product from the solvent extraction stage immediately following the solvent extraction stage are allowed to separate in a stage gravity settler.

27. The method as claimed in claim 26, further comprising introducing an amount of a hydrocarbon diluent into at least one of the solvent extraction stages.

28. The method as claimed in claim 27 wherein the hydrocarbon diluent is comprised of a naphthenic type diluent.

29. The method as claimed in claim 26, further comprising introducing an amount of a hydrocarbon diluent into a final solvent extraction stage.

30. The method as claimed in claim 29 wherein the hydrocarbon diluent is comprised of a naphthenic type diluent.

31. The method as claimed in claim 26 wherein in the at least one of the solvent extraction stages an intra-stage recycle ratio by weight of the stage intra-stage recycle component to the stage solvent extraction feed material is between 0.1 and 1.5.

32. The method as claimed in claim 31 wherein the intra-stage recycle ratio is between 0.5 and 1.

33. The method as claimed in claim 26 wherein in each of the solvent extraction stages the stage intra-stage recycle component is produced and the entire stage intra-stage recycle component is mixed with the stage solvent extraction feed material.

34. The method as claimed in claim 26 wherein the extract is produced as the overflow product in a first solvent extraction stage and wherein the raffinate is produced as the underflow product in a final solvent extraction stage.

* * * * *